United States Patent [19]

Ruff et al.

[11] Patent Number: 4,787,542

[45] Date of Patent: Nov. 29, 1988

[54] FOIL DISPENSER FOR AND METHODS OF DISPENSING FOIL

[75] Inventors: Stanley L. Ruff, New Rochelle, N.Y.; Albert Stubbmann, Franklin Lakes, N.J.

[73] Assignee: Clik-Cut, Inc., New Rochelle, N.Y.

[21] Appl. No.: 906,911

[22] Filed: Sep. 15, 1986

[51] Int. Cl.[4] ..... B65D 85/672

[52] U.S. Cl. ..... 225/1; 225/52; 225/54; 225/85; 225/90; 225/91

[58] Field of Search ..... 225/90, 91, 48, 45, 225/19, 20, 51-54, 80, 77, 88, 47, 85

[56] References Cited

U.S. PATENT DOCUMENTS

| | | | |
|---|---|---|---|
| 2,825,452 | 3/1958 | Klein | 255/47 X |
| 3,011,688 | 12/1961 | Klein et al. | 225/47 |
| 3,134,525 | 5/1964 | Holcombe | 225/47 |
| 3,510,033 | 5/1970 | Schramm et al. | 225/91 X |
| 3,771,700 | 11/1973 | Garr | 225/91 X |
| 4,493,446 | 1/1985 | Wirth | 225/90 X |
| 4,586,639 | 5/1986 | Ruff et al. | 225/90 X |

*Primary Examiner*—Frank T. Yost

*Attorney, Agent, or Firm*—Kirschstein, Kirschstein, Ottinger & Israel

[57] ABSTRACT

A dispenser for dispensing sheet material, particularly metallic foil, positions each successively leading end region of the foil, after a preceding length of the foil has been severed, to stand freely in a generally upright condition away from a severing means which is preferably provided without sharp serrated cutting teeth to protect a user from injury during use of the dispenser, and to provide the user with ready access to each upstanding leading end region of the foil.

30 Claims, 11 Drawing Sheets

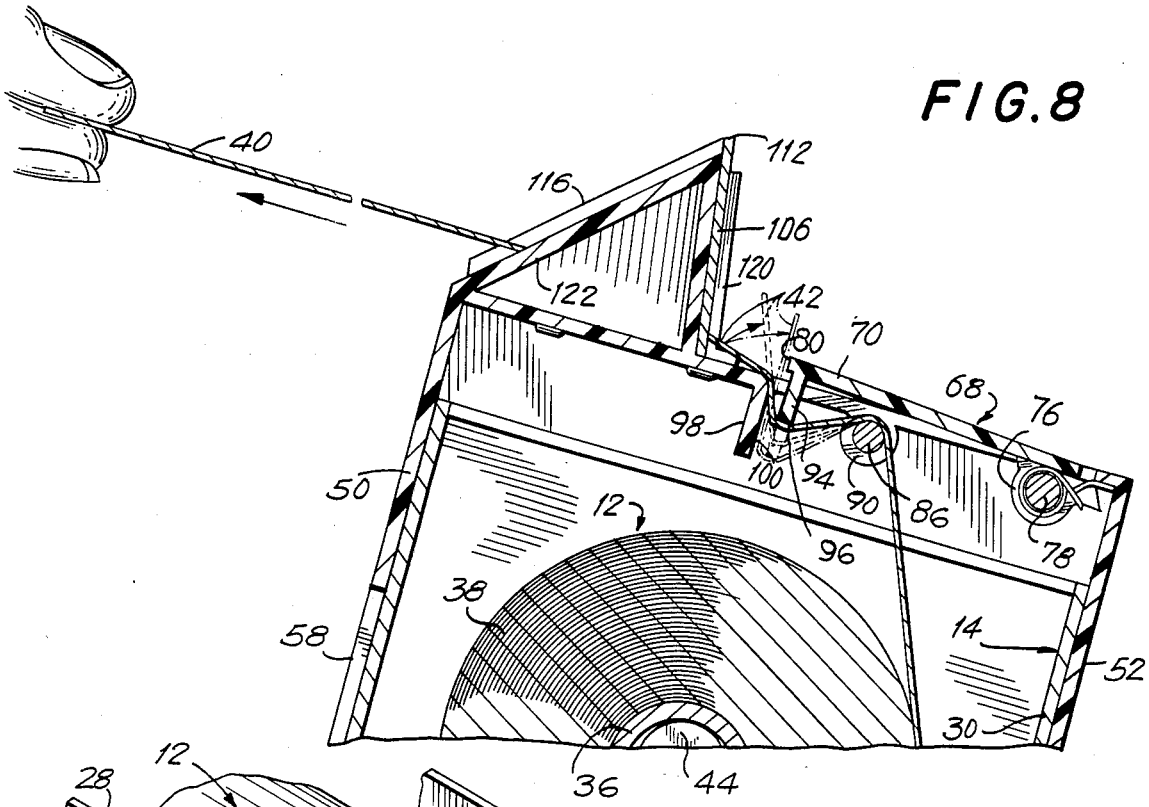
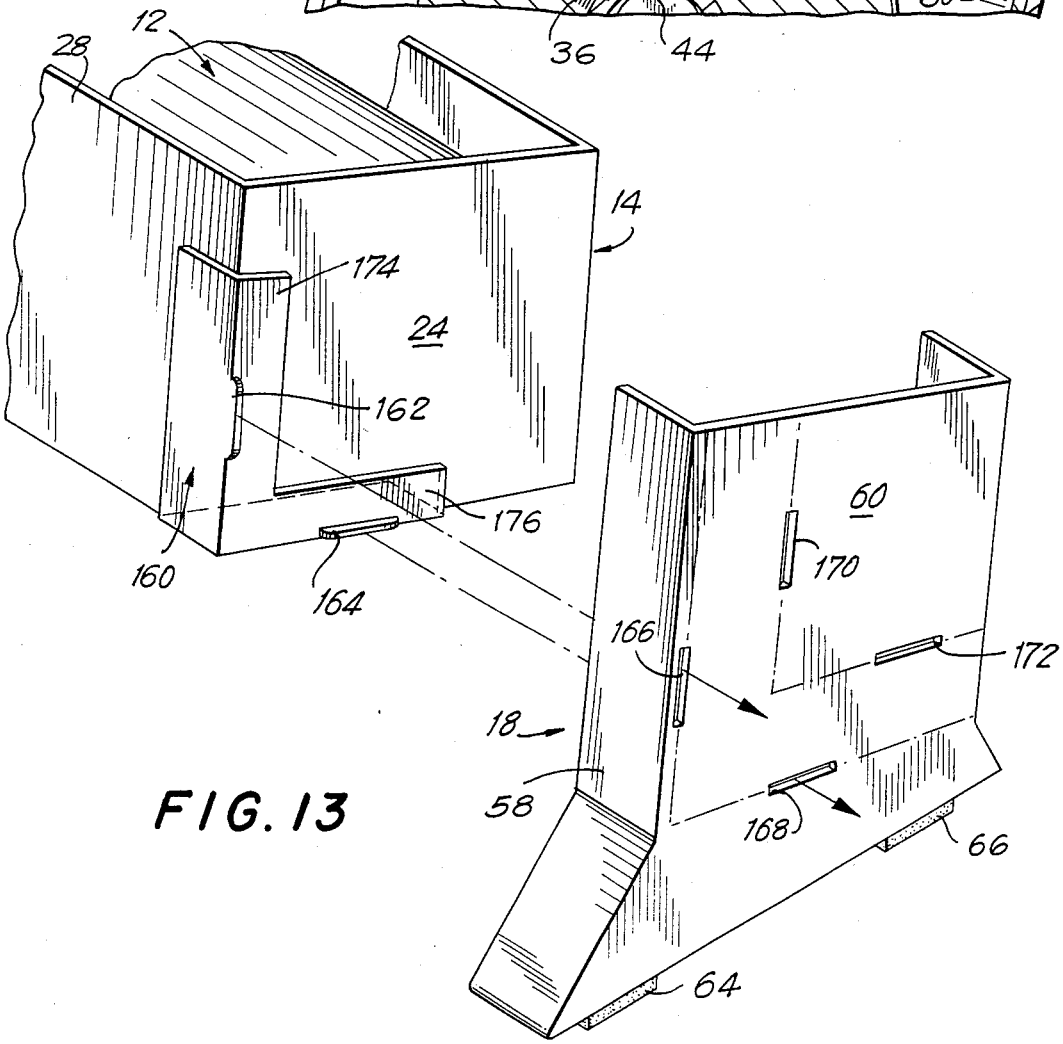
FIG. 13

FIG. 9
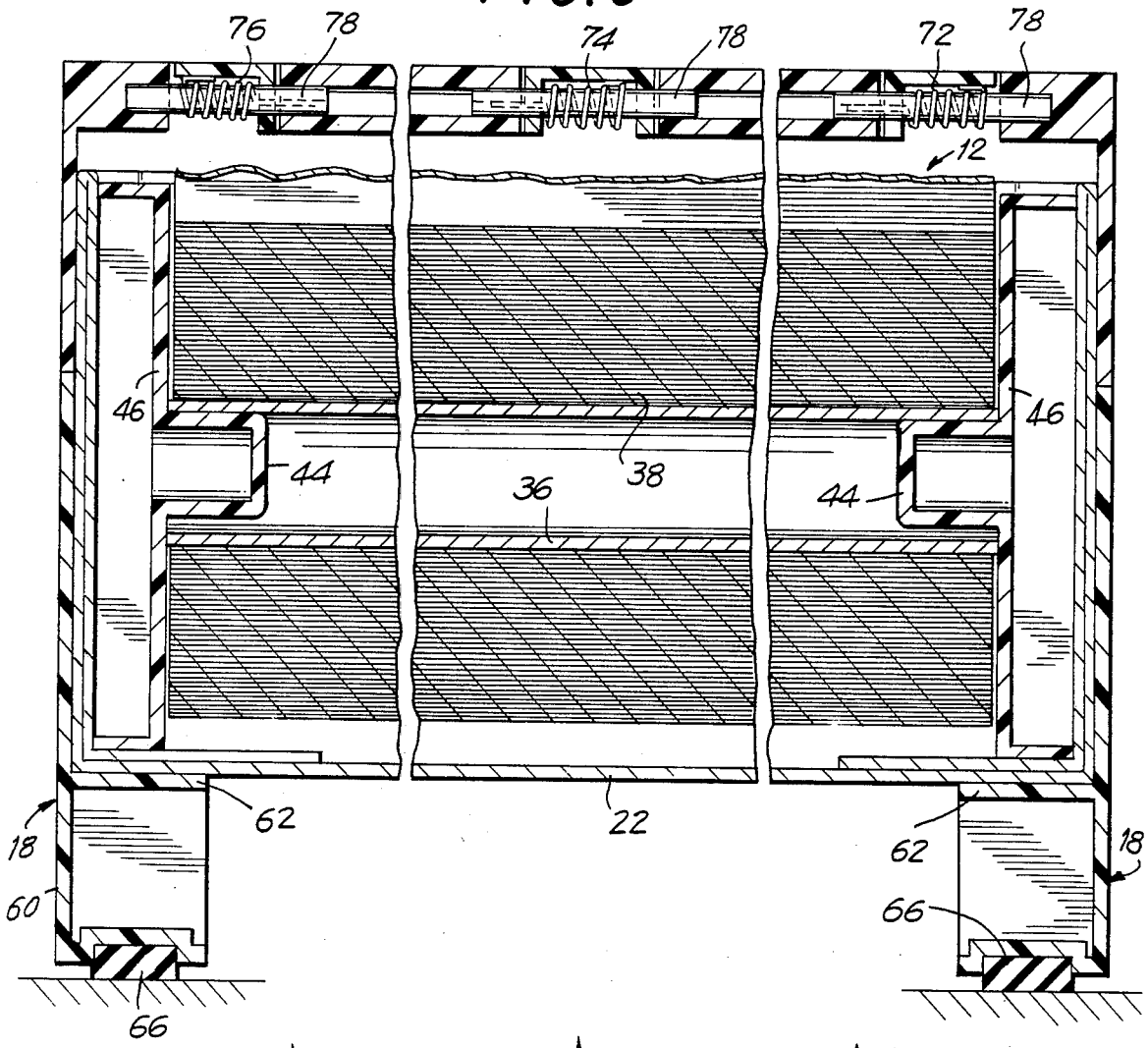
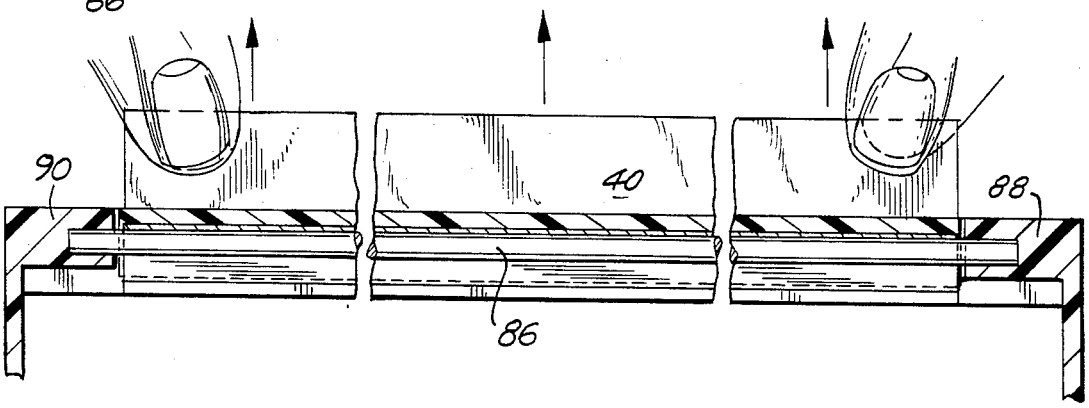
FIG. 10

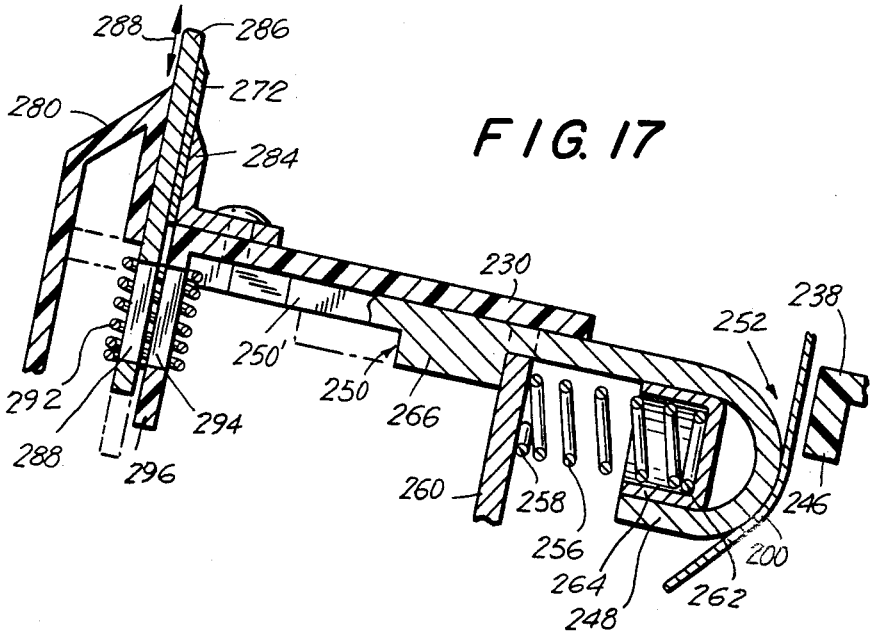
FIG. 17
FIG. 18
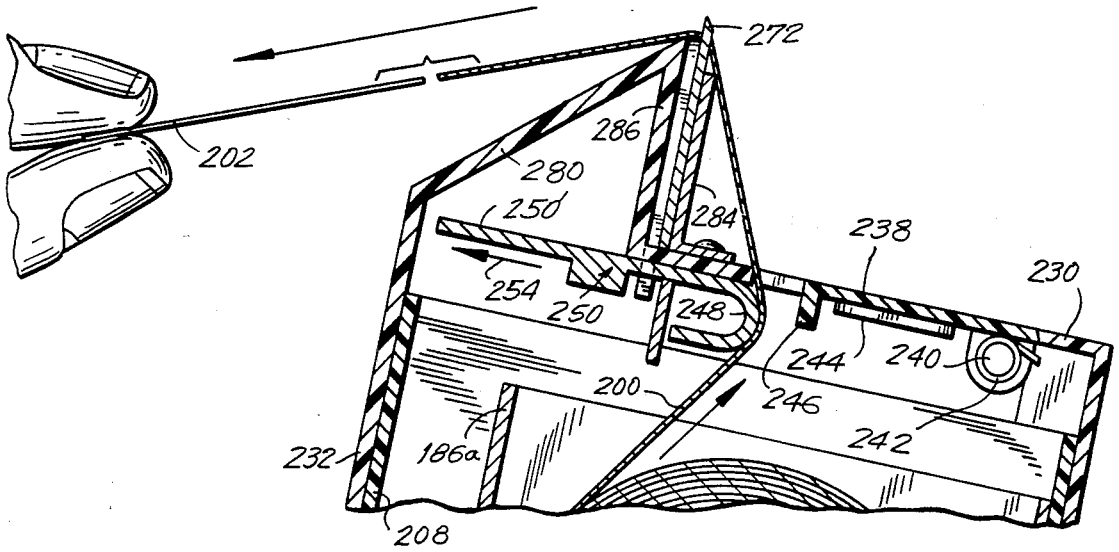
FIG. 20
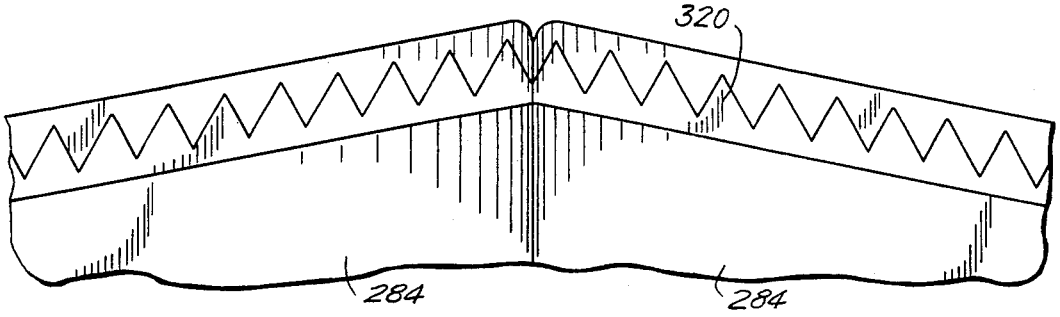

FOIL DISPENSER FOR AND METHODS OF DISPENSING FOIL

BACKGROUND OF THE INVENTION

1. Field of the Invention

This invention generally relates to a dispenser for, and a method of, safely and efficiently dispensing sheet materials, particularly metallic foil, as well as to a method of wrapping items with the dispensed foil.

2. Description of the Prior Art

It has been well known, for both commercial and domestic purposes, to dispense sheet wrapping materials, such as metallic foil, plastic film, waxed paper, paper and the like. The sheet wrapping material was often supplied in a roll mounted for rotation in a cardboard box. For domestic purposes, the roll was relatively light in weight and of small capacity so that the box could be easily held in a user's hand, and a leading end region of the sheet could be pulled out of the box with the other hand. For commercial purposes, the roll was of greater capacity and heavier so that the box typically rested on a support surface, such as a countertop, and the user pulled the leading end region of the sheet out of the thus-supported box.

In the conventional parallelepiped-shaped box for dispensing aluminum foil, a serrated cutting blade having a row of generally triangularly-shaped, small, closely-spaced, sharp teeth was fixedly mounted on the front wall of the box so that the teeth projected beyond the upper edge of the front wall. A top cover was hingedly connected to the rear wall of the box. The foil was unwound from the bottom of the roll along the inside of the front wall and, in order to sever a desired length of the withdrawn foil, the trailing end region of the foil was urged against one side, e.g. the right side, of the serrated cutting blade, and thereupon, the foil was severed across its width from its right side toward its left side in a progressive piercing/tearing action.

Although accepted for its intended purpose, the known conventional dispenser for dispensing metallic foil has not proven to be safe, efficient, and reliable in use. For example, the small, closely-spaced, sharp teeth of the cutter blade were constantly exposed, and could cut and injure a user, particularly if the user was compelled, under certain circumstances, to reach into the box in the immediate vicinity of the cutter blade to grasp the free leading end region of the foil, especially if the user happened to move his hand lengthwise of, and in contact with, the blade. Sometimes the cutter blade was not mounted correctly at the upper marginal portion of the front wall of the box so that the teeth did not extend, or at least only partially extended, past the upper edge of the box, thereby causing either no or, at best, uneven, cutting of the foil. Often, the trailing end region of the preceding foil fell back into the box, and the user was compelled to grope around in the box to grasp the next leading end region. This, of course, was very time consuming, especially in assembly-line wrapping operations.

Another problem associated with the conventional foil dispenser was that the top cover was usually lifted out of the way each time the user wished to grasp the next leading end region of the foil. This was such an annoyance to many users that the top cover was often torn off the box, thereby enabling dirt, germs, crumbs and other contaminants, and vermin to enter the box. This was a health hazard, particularly in those applications where food was being wrapped, and sanitation was of the utmost importance.

The physical characteristics of the metallic foil itself also rendered the conventional box dispenser inefficient. Metallic foil, e.g. aluminum, has a very low shear resistance and tends to rip, i.e. "run", in any direction that a stress occurs. A nick anywhere in the aluminum foil can cause a rip along an undesired path. Each tooth on the cutter blade was capable of starting its own uncontrolled rip. Any such uncontrolled rip ruined the withdrawn length of the foil so that another length was typically withdrawn, thereby wasting foil.

As noted previously, the foil withdrawn from the conventional dispenser was severed by tearing the foil from side to side on the saw-like teeth. This could cause little specks of foil to be sawed off the foil and to be found on the item being wrapped, an obviously undesirable result in food-wrapping applications. Also, the user's hands often struck the tabletop on which the dispenser rested during the side-to-side severing of the foil. Furthermore, when the roll was almost spent, the conventional box tended to tip and fall forwardly, due to the low weight of the roll, when the user pulled the leading end region of the foil from the roll with the same force that the user exerted when the roll was fresh and, therefore, heavier.

Dispensers for dispensing sheet materials were disclosed in U.S. Pat. Nos. 4,586,639, 4,598,531; 4,646,995; and 4,610,407, as well as in the prior art identified in said patent applications and patent.

SUMMARY OF THE INVENTION

1. Objects of the Invention

It is a general object of this invention to overcome the aforementioned drawbacks of earlier metallic foil dispensers.

It is an object of this invention to reduce, if not entirely eliminate, the safety hazard involved in the utilization of constantly-exposed, small, closely-spaced, sharp teeth which can cut and injure a user.

It is another object of this invention to reliably ensure uniform severing of a metallic foil across its entire width.

It is a further object of this invention to prevent the leading end region of the foil from falling back into the dispenser and to concomitantly prevent the user from groping around within the dispenser to grasp the leading end region of the foil.

It is still another object of this invention to reduce, if not entirely eliminate, the health hazard involved in exposing the interior of a housing to dirt and other contaminants, and vermin.

It is yet another object of this invention to prevent uncontrolled rips from ruining and wasting foil.

It is a still further object of this invention to prevent the cutting of foil on saw-like teeth.

It is another object of this invention to prevent the tipping of the dispenser, particularly when the roll is almost spent.

It is still another object of this invention to prevent one's hands from striking the support surface on which the dispenser rests.

It is a further object of this invention to prevent foil specks from appearing on an item to be wrapped.

Yet another object of this invention is to position each leading end region of the foil within easy reach of the user and at a safe location away from a cutting element.

Still another object of this invention is to provide a novel, safe, efficient and reliable dispenser for, and method of, dispensing sheet material, particularly metallic foil.

Another object of this invention is to provide a novel method of wrapping items with sheet material, particularly metallic foil.

2. Features of the Invention

In keeping with these objects, and others which will become apparent hereinafter, one feature of the invention resides, briefly stated, in a dispenser comprising a support having a base and a top above the base, with the support bounding an opening. In a preferred construction of this invention, the support includes a tranversely elongated housing having a base wall, a pair of end walls, a front wall and a rear wall. The support further includes a discrete cover having a top wall, the discrete cover being mounted on the housing so that its top wall overlies the base wall of the housing. In addition, the support may further include means for rearwardly tilting the housing so that an upper marginal portion of the front wall is at a higher elevation relative to a generally planar horizontal support surface than an upper marginal portion of the rear wall of the housing.

The dispenser further comprises, or is adapted to hold, a roll mounted on the support for turning movement about an axis, usually horizontal. The roll has a coiled, continuous, imperforate supply of a sheet material, e.g. a low-shear-resistant, broad metallic, e.g. aluminum foil, wound about the axis. The foil is unwindable during use for successively paying out a desired length of the foil when successive leading end regions of the foil are respectively manually grasped by a user, and the desired length of the foil is withdrawn from the roll along a path through the opening in the support to an elevated position at least partially overlying the support.

During the withdrawal of the foil, the dispenser also provides means for exerting a drag on each successively withdrawn length of the foil as it is payed out to tauten the same. Each successively withdrawn taut length of the foil is severed by a transverse severing means mounted on the support, and operative for transversely severing each withdrawn length of the foil when the same is moved from the elevated position onto the severing means in a direction generally downwardly toward the base.

In further accordance with this invention, the dispenser includes means on the support for positioning each successive leading end region of the foil, after the preceding length of the foil has been severed, to stand freely in a generally upright condition away from the severing means and in an unsupported manner at and along opposite surfaces of each upstanding leading end region of the foil.

Hence, one advantageous feature of this invention is that the user may gain ready and safe access to each upstanding leading end region of the foil anywhere along the transverse width thereof. This free-end-of-the-foil-upstanding feature reliably prevents the leading end region of the foil from falling back into the dispenser, and concomitantly prevents the user from having to grope around within the dispenser to grasp the leading end region of the foil. The positioning of each upstanding leading end region of the foil within easy reach of the user and at a safe location remote from the severing means on the support reduces, if not entirely eliminates, the safety hazard previously involved in providing a severing means with constantly exposed teeth which were sharp enough to cut and injure a user, particularly when the user was compelled to reach into the box in the immediate vicinity of the severing means to grasp the free leading end region of the foil.

The multi-partite construction of the support, wherein a discrete cover is mounted on the housing, is particularly advantageous because it reduces, if not entirely eliminates, the health hazard previously involved in the prior art in exposing the interior of the support to dirt, other contaminants, and vermin. No longer need the user lift a hinged top cover out of the way each time the user wishes to grasp the next leading end region of the foil, and no longer need the user tear off the hinged top cover. In applications where food is being wrapped and where sanitation is of the utmost importance, the health aspects of the dispenser in accordance with this invention are of great significance.

As for the severing means, it is particularly advantageous if it comprises a piercing portion operative for piercing the foil moved downwardly thereon, and a pair of tearing portions each having dull, non-serrated tear edges extending downwardly and forwardly away from the piercing portion, and operative for tearing the foil moved downwardly thereon across the entire width of the foil. This type of severing means reliably ensures uniform severing of a foil in a substantially straight, linear severance across the entire width of the foil. In addition, foil is not ruined and wasted as in the prior art, because the foil is not severed with chevron-shaped trailing edges and with saw-like teeth, and uncontrolled rips are prevented from being started.

The piercing portion, which is preferably located centrally of the dispenser on the top wall thereof, pierces a central portion of the foil moved downwardly thereon and, in effect, anchors the foil. Continued downward movement of the foil causes the foil to tear along the non-serrated edges in opposite directions and transversely outwardly from the piercing portion. Due to the controlled tearing of the foil along the non-serrated edges, foil specks are prevented from being deposited on an item to be wrapped.

In addition, the dull, non-serrated tear edges themselves eliminate the prior art safety hazard involved in having constantly exposed, small, closely-spaced teeth which are sharp enough to nick and injure a user. The piercing portion represents the only sharp edge of the severing means and, in a preferred construction and use of this invention, the user's hands and arms never encounter this central piercing portion. More particularly, the user's hands grasp each upstanding leading end region of the foil at the right and left sides thereof and, during withdrawal of the foil, never pass over the central piercing portion.

The withdrawal of the foil from the roll and the subsequent movement of the foil onto and past the severing means is performed in a single, uniform motion. Due to the rearward tilt of the housing and the elevated position of the severing means on the top wall of the support, the user's hands are prevented from striking the support surface on which the dispenser rests. Moreover, the rearward tilt of the housing prevents the dispenser from being tipped over, particularly when the roll is almost spent.

The support also advantageously includes a door mounted on the top wall of the cover for movement among a plurality of open positions in each of which the successively withdrawn foil lengths are at least partially juxtaposed with and overlie the top wall, and a closed position in which each successive leading end region is in a generally upright, upstanding condition relative to the top wall. The door and the top wall have longitudinal edges bounding the aforementioned opening through which the foil is withdrawn and, in the closed position of the door, the longitudinal edges are in close, adjacent, confronting relationship with each other and form a slot through which the foil extends.

In a preferred construction, the door is affirmatively urged toward the closed position by biasing means, preferably constituted by at least one, and preferably more, biasing spring. The drag exerted on each successively withdrawn length of the foil,as it is payed out, to tauten the same is exerted not only by the weight of the roll, but, advantageously, also by a foil-engaging drag surface provided on the door. The biasing means which affirmatively urges the door to the closed position also affirmatively urges the drag surface into engagement with the foil to ensure that a sufficient drag is present, even when the roll is nearly spent.

The aforementioned foil-leading-end-positioning means preferably is constituted by a transverse projection on, and extending downwardly from, the door. This projection cooperates with a transverse surface provided on the top wall adjacent the projection in the closed position of the door. The projection engages one side of the foil, and urges the opposite side of the foil against the transverse surface to at least partially fold the foil and cause each leading end region to stand substantially erect when the door is in the close position. This arrangement is possible because, although the metallic foil is easily bendable, it will remain in any position to which it is bent.

Another advantageous feature of this invention resides in a reference surface which engages and positions the foil at the same reference position for all withdrawals of the foil. This is of particular advantage when the roll is almost completely spent, since it ensures that, no matter how much foil remains on the roll, the projection and cooperating transverse surface will be operative to cause each leading end region of the foil to stand substantially erect.

The method of dispensing the foil comprises the following steps: The foil is initially unwound by manually grasping successive leading end regions of the foil and withdrawing desired lengths of the foil from the roll to elevated positions at least partially overlying the support. A drag is exerted on each successively withdrawn length of the foil to tauten the same during withdrawal. Each successively withdrawn taut length of the foil is thereupon severed by manually moving the foil in a single downward motion from a respective elevated position in a generally downward direction onto a severing element mounted on the support. The method also comprises the step of positioning each remaining successive leading end region of the foil, after the preceding length of the foil has been severed, away from the severing element.

Another desirable aspect of this invention relates to a method of wrapping items with the foil, the method including positioning an item to be wrapped directly in front of the dispenser and, during the single downward motion of the foil, lowering the severed foil over the item. The item is then wrapped with the overlaid severed foil. This wrapping method obviates the prior art wrapping techniques wherein the severed foil did not immediately lie in a plane above the item being wrapped, but, rather, was located laterally offset to the side of the dispenser, thus requiring the user to perform another motion, i.e. to bring the severed foil back from its offset position to a position directly above the item being wrapped and, thereupon, to lower the foil onto the item.

Advantageously, the base of the support includes a pair of legs mounted at opposite ends of the housing, each leg having a broad base to prevent tipping, and support pads for frictionally engaging the support surface with a high coefficient of friction to prevent the dispenser from being dragged along the support surface during the withdrawal of the foil.

Another feature of this invention relates to the ability of a single cover to be mounted on housings of different sizes. For example, a housing having length, width and height dimensions sufficient to accommodate a 500 ft. roll of aluminum foil may, under certain circumstances, be larger in width and height to accommodate a roll having 1000 ft. of aluminum foil. For this purpose, a rear portion of the cover is adjustably movable relative to a front portion of the cover.

Yet another safety aspect of this invention is embodied in protecting the user from contacting even the above-described piercing and tearing portions of the severing means. The piercing portion, as described previously, represented the only sharp edge of the severing means and, even though the user's hands and arms never encounter this piercing portion during intended use of the dispenser, the possiblity exists, however slight, that a user may forcefully bring his fingers, arms or other body parts, or perhaps may even fall against, the piercing portion and injure himself.

To protect against even these minimal safety hazards, this invention further proposes mounting a safety means on the support for displacement relative to the severing means between a raised guarded position and a lowered cutting position. More specifically, the safety means includes a spring-biased guard which normally extends above the piercing and tearing portions in the raised guarded position and, hence, the guard prevents one from injuring himself, because, even in the event that one fell against the front of the dispenser, or even if one forcefully brought one's hands down against the dispenser in the region of the severing means, one would first strike the guard, and not the severing means, due to the raised portion of the guard. The guard is locked in the raised position during each successive withdrawal of the foil.

Means are further provided for unlocking and releasing the guard during each successive downward movement from the aforesaid elevated position in a downward direction toward the severing means to enable each successively withdrawn taut length of the foil to displace the guard to the lowered cutting position in which the guard lies below the piercing and tearing portions and enables severing of the foil to be performed. Once the severing has been completed, each successive leading end region of the foil is positioned away from the severing means as previously described and, in addition, the spring-biased guard is returned by spring-restoring action to the normally raised guarded position in which the severing means is rendered inoperative for severing.

The novel features which are considered as characteristic of the invention are set forth in particular in the appended claims. The invention itself, however, both as to its construction and its method of operation, together with additional objects and advantages thereof, best will be understood from the following description of the specific embodiments when read in connection with the accompanying drawings.

Figure 2:
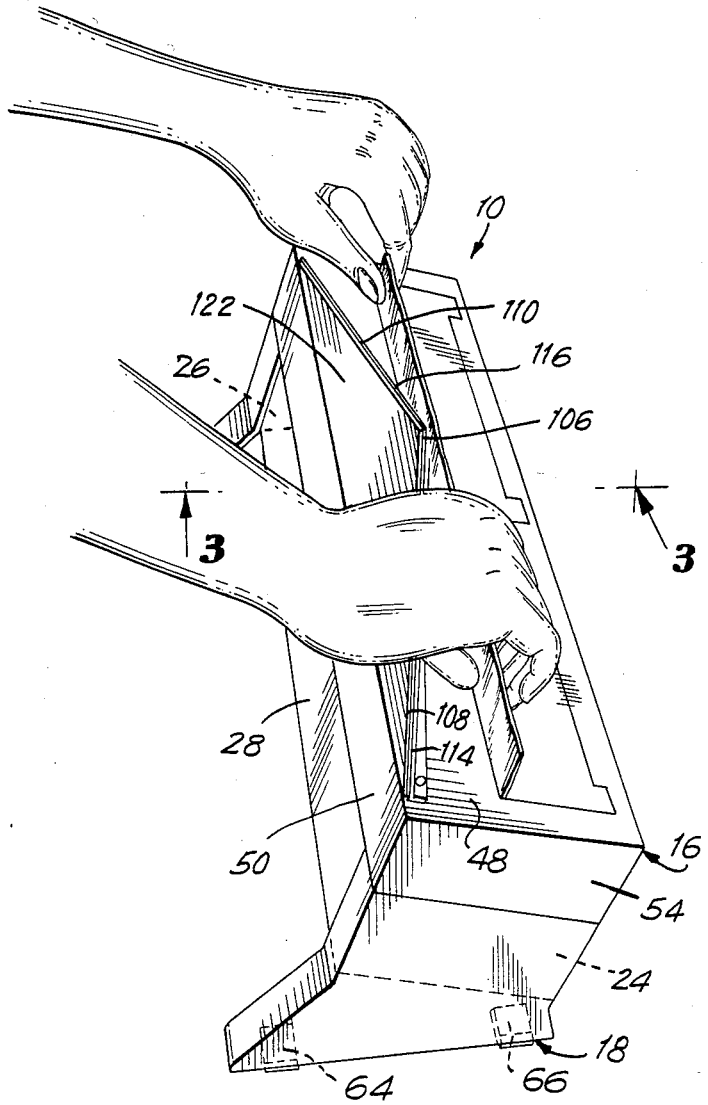
FIG. 2 is a perspective view showing the dispenser of FIG. 1 at an initial stage of use.
Figure 3:
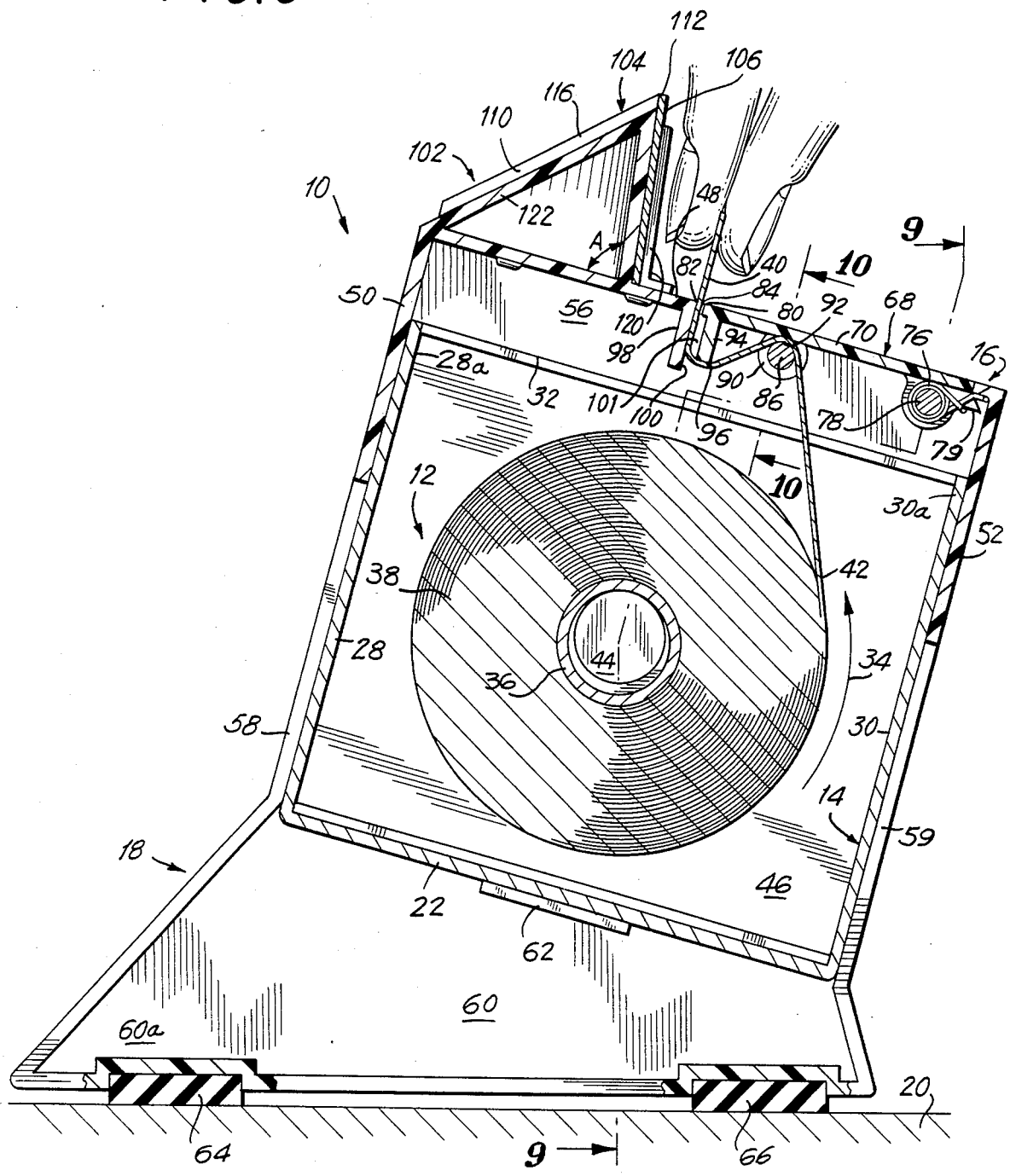
FIG. 3 is an enlarged sectional view taken along line 3—3 of FIG. 2.
Figure 4:
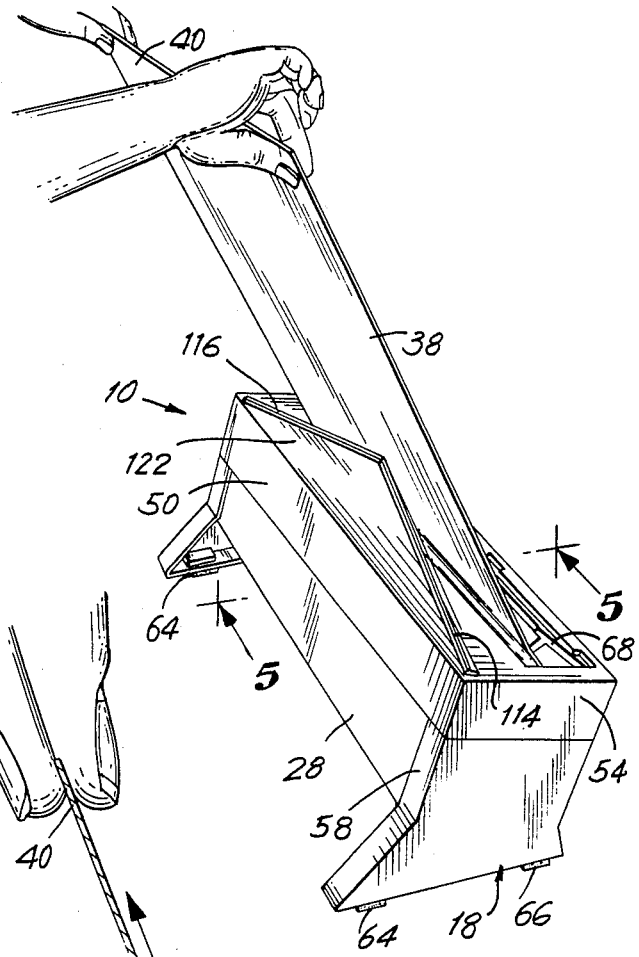
Figure 5:
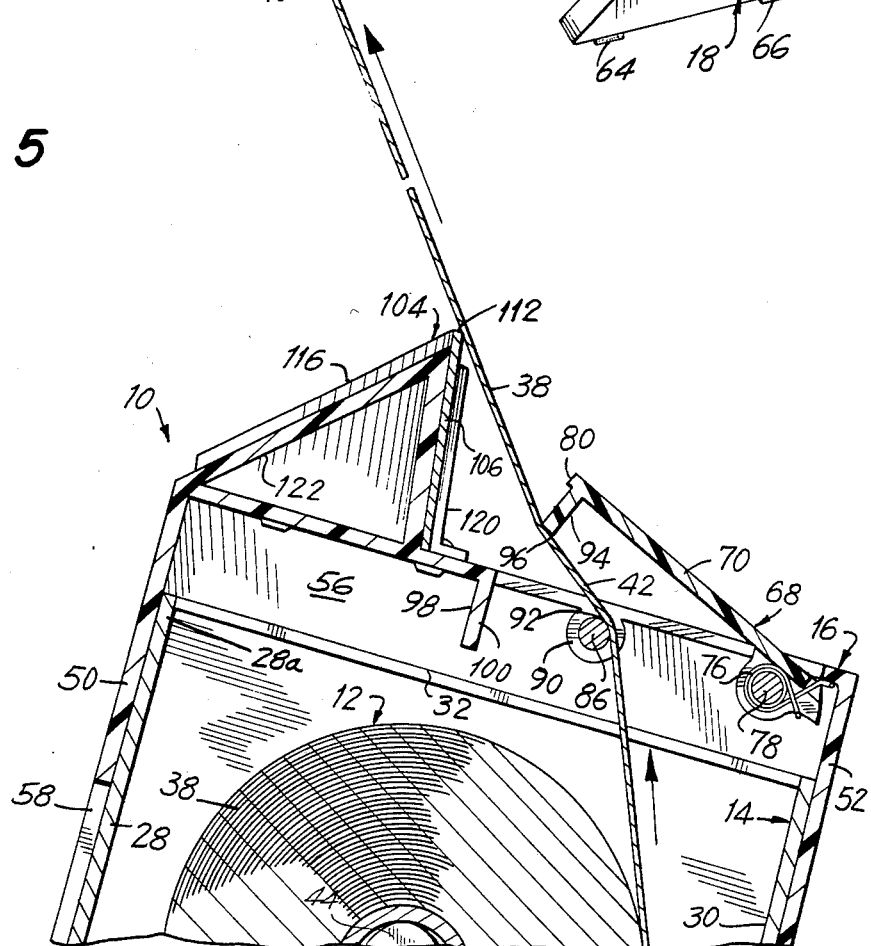
Figure 6:
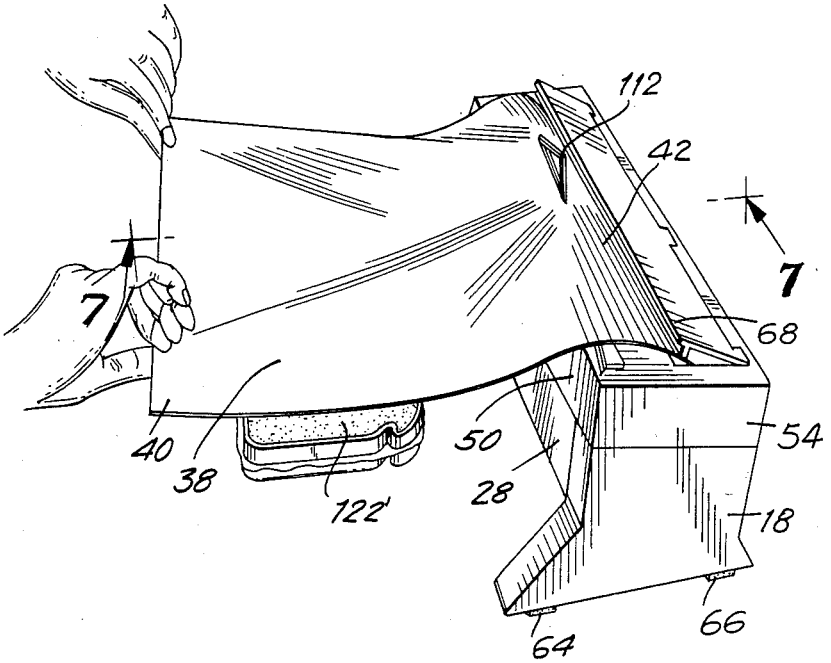
Figure 7:
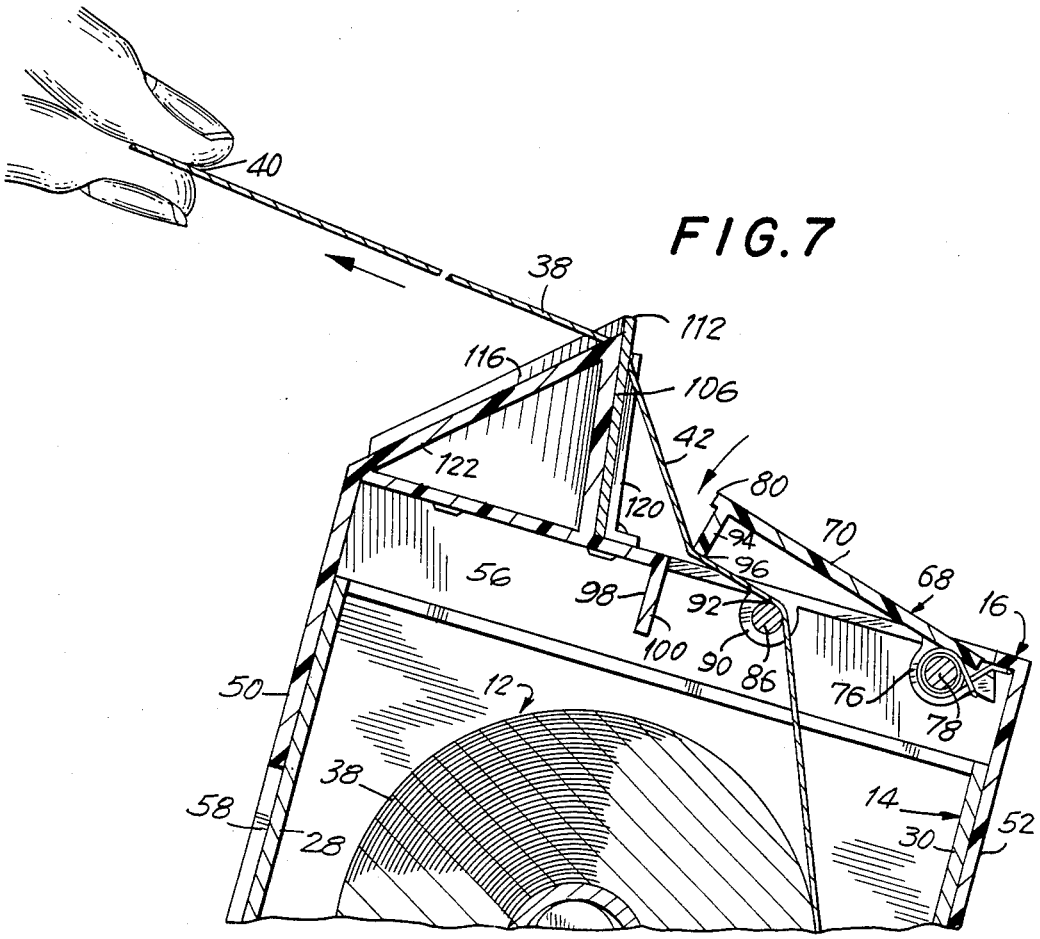
Figure 12:
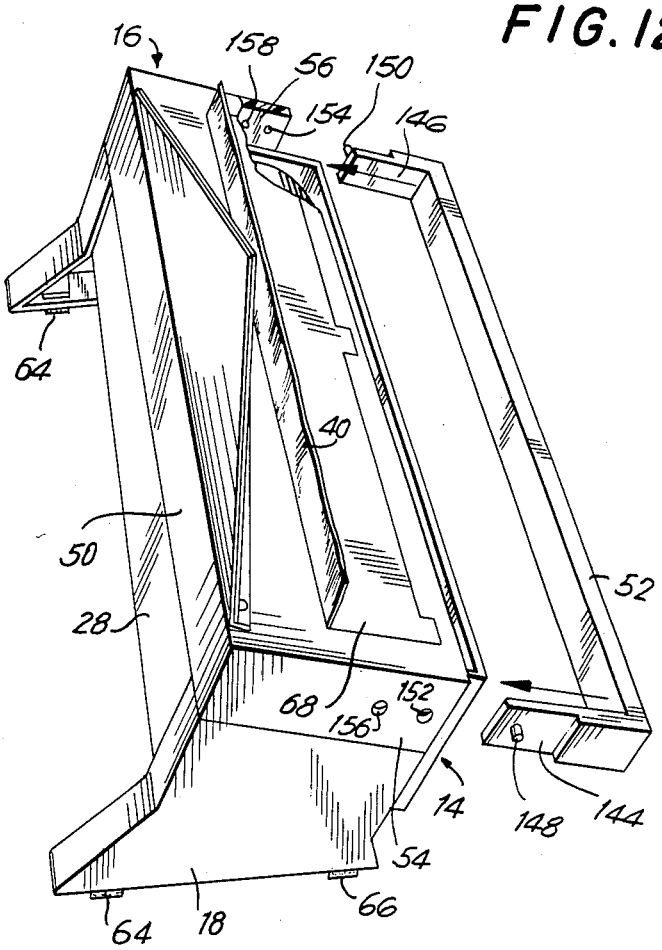
Figure 11:
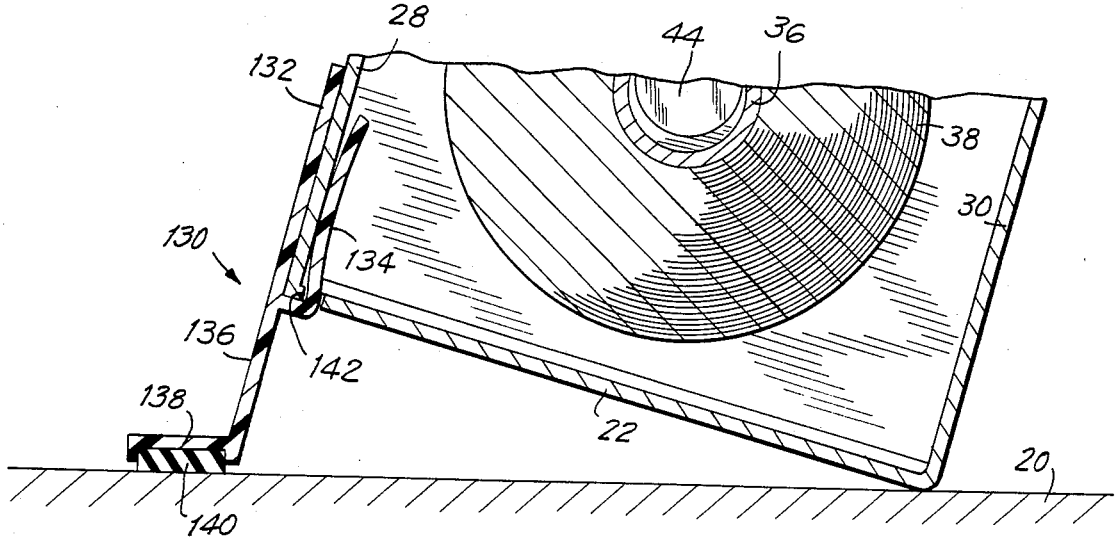
Figure 14:
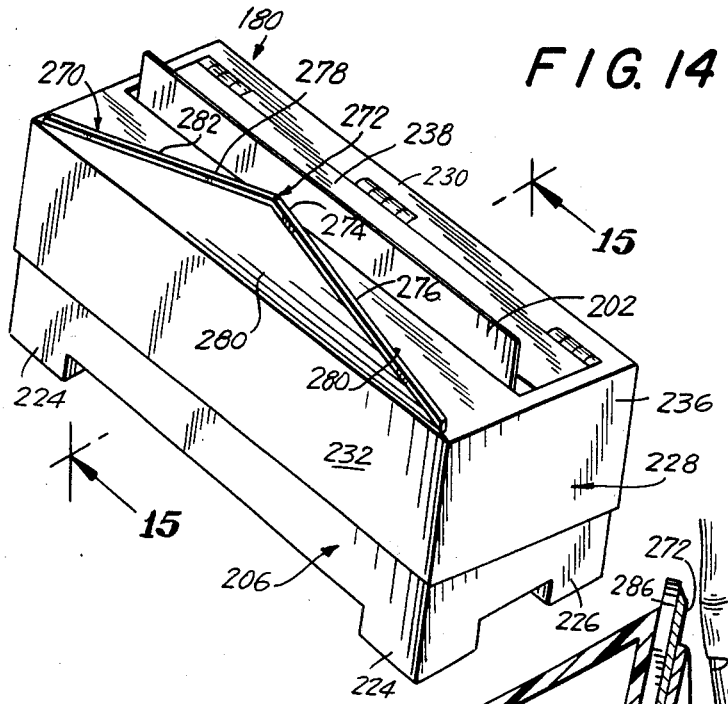
Figure 15:
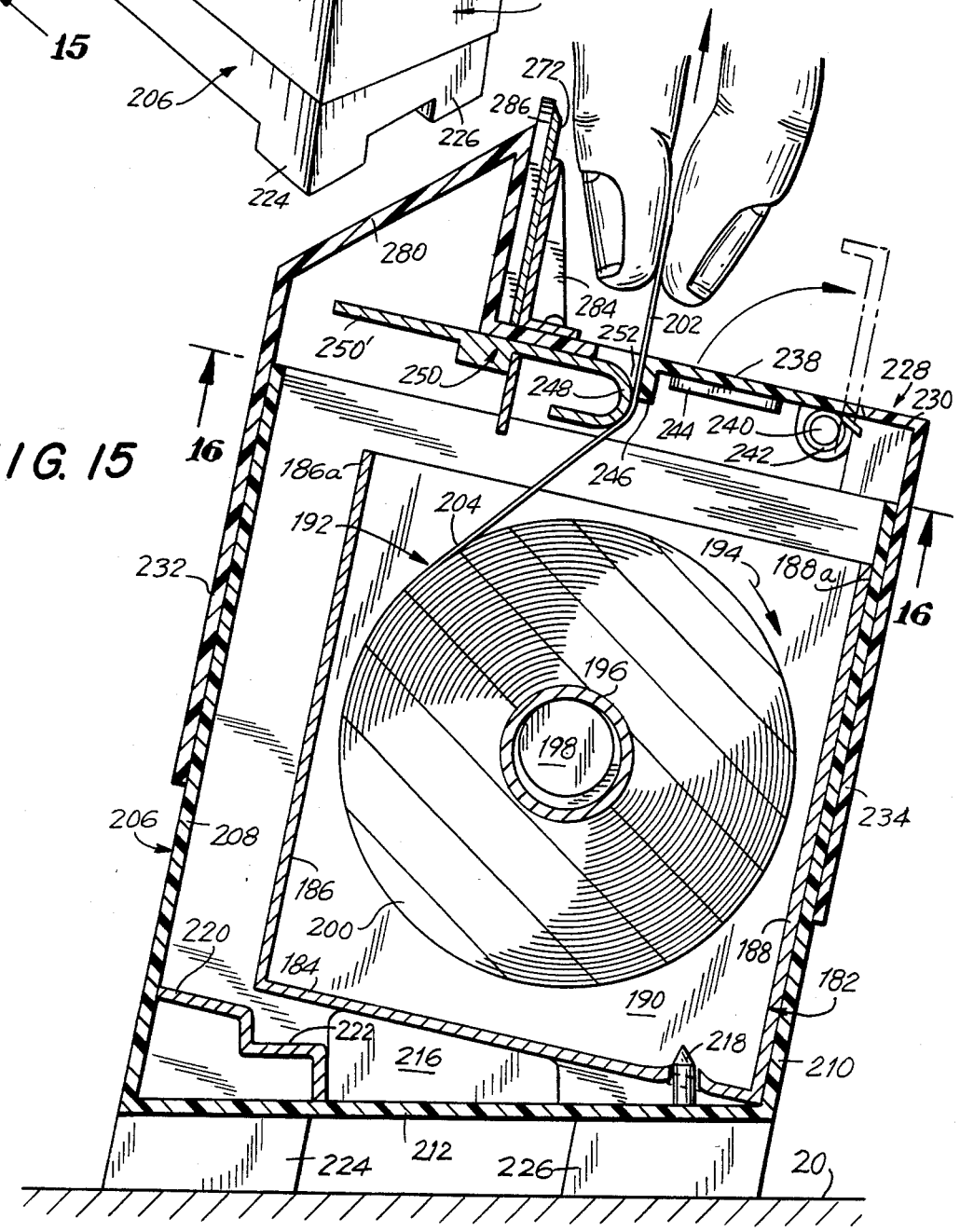
Figure 16:
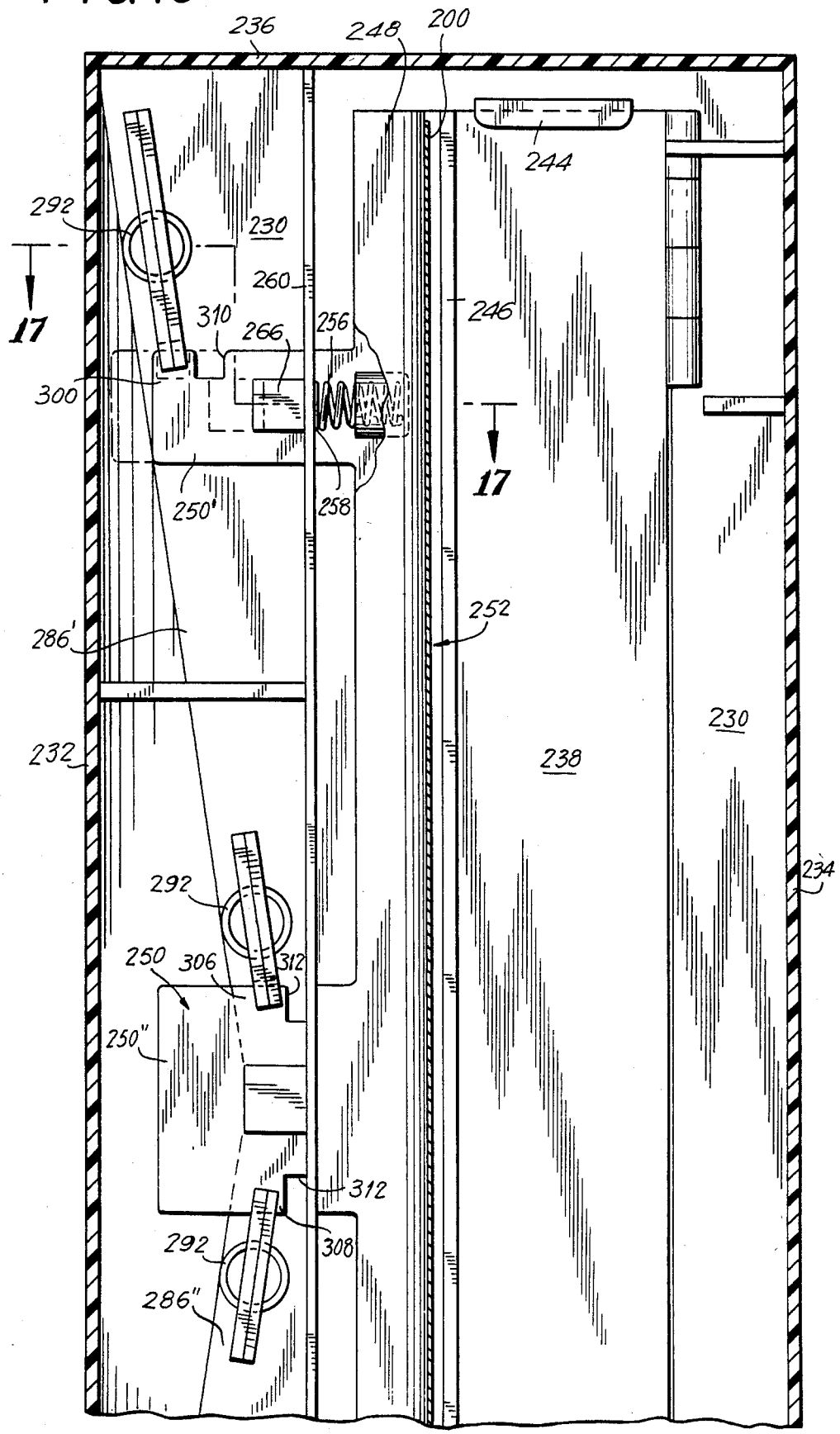
Figure 19:
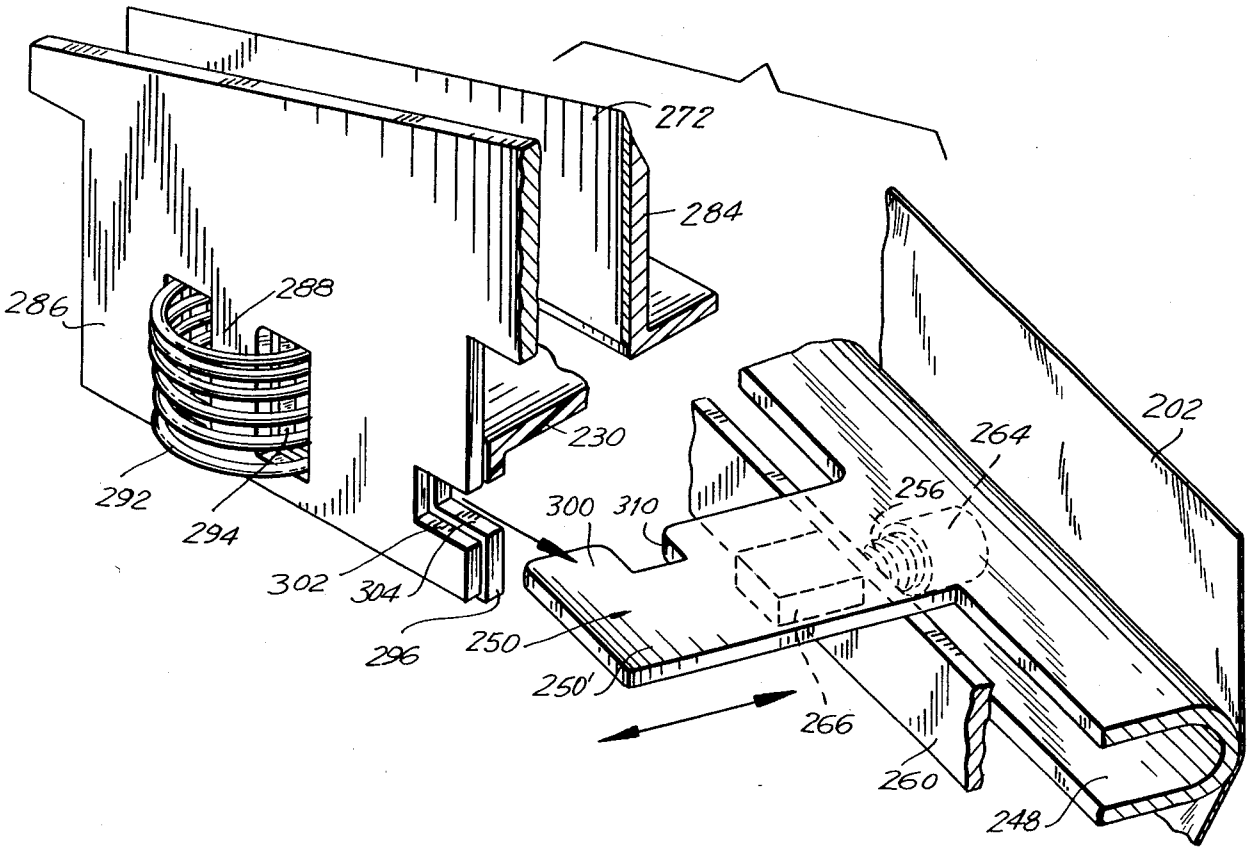

FIG.,4 is a perspective view analogous to FIG. 2, but in a subsequent stage of use;

FIG. 5 is an enlarged, partially broken-away, sectional view taken along line 5—5 of FIG. 4;

FIG. 6 is a perspective view analogous to FIG. 4, but in a later stage of use;

FIG. 7 is an enlarged, partially broken-away, sectional view taken along line 7—7 of FIG. 6;

FIG. 8 is an enlarged sectional view analogous to FIG. 7, but showing progressive stages in the severing of a length of foil;

FIG. 9 enlarged sectional view taken along line 9—9 of FIG. 3;

FIG. 10 is an enlarged sectional view taken along line 10—10 of FIG. 3;

FIG. 11 is a perspective exploded view of an adjustable cover mounted on a housing of a dispenser in accordance with this invention;

FIG. 12 is a partially broken-away view of the lower portion of a dispenser housing showing a housing-tilting let member attached to a lower marginal region of the housing for rearwardly tilting the housing relative to a support surface;

FIG. 13 is a perspective exploded view of adjustable legs mounted below a housing of a dispenser in accordance with this invention;

FIG. 14 is a perspective view of another dispenser in accordance with this invention at an initial stage of use;

FIG. 15 is an enlarged sectional view taken along line 15—15 of FIG. 14;

FIG. 16 is an enlarged sectional view taken along line 16—16 of FIG. 15;

FIG. 17 is an enlarged sectional view taken along line 17—17 of FIG. 16;

FIG. 18 is a sectional view analogous to FIG. 15, but in a subsequent stage of use;

FIG. 19 a greatly enlarged, exploded perspective view of details the dispenser of FIG. 14; and FIG. 20 is a fragmentary view of a modification of the severing blade especially adapted to be used for severing plastic film with the dispenser of FIG. 14.

DETAILED DESCRIPTION OF THE PREFERRED EMBODIMENTS

Figure 1:
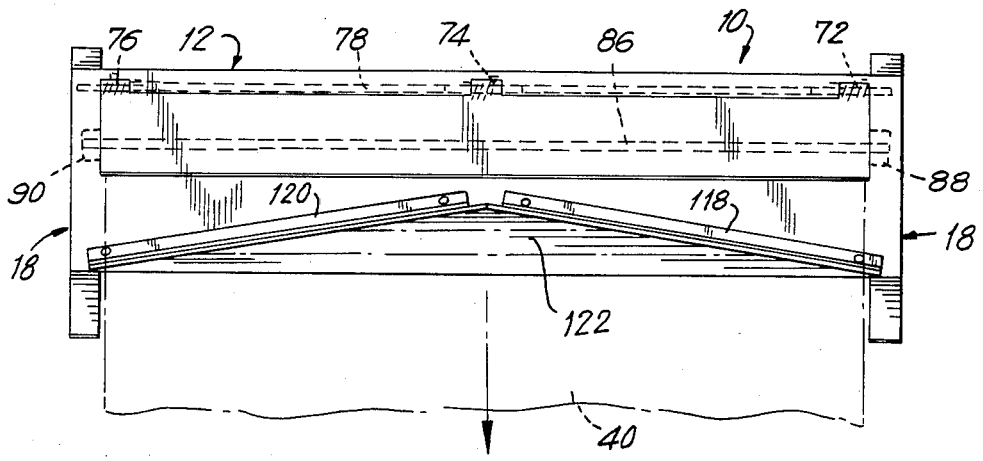
FIG. 1 is a top plan view of a dispenser in accordance with this invention.

Referring now to the drawings, reference numeral 10 especially a roll 12 of a metallic foil, particularly aluminum foil. As best shown in FIGS. 1-3, the dispenser 10 comprises a support of multi-partite construction. The support includes a housing 14, a cover 16 mounted on the housing 14, and a pair of support legs 18 for supporting the housing 14 on a generally planar support surface 20 such as a tabletop, a countertop or similar work surface.

The housing 14 has a generally elongated paralellepiped-shaped configuration having a rectangular cross-section, and has a planar base wall 22 formed of one or more flaps, a pair of planar end walls 24, 26 spaced longitudinally apart from each other, and a planar front wall 28 and a planar rear wall 30 spaced transversely apart from each other. All of the housing walls 22, 24, 26, 28, 30 bound an interior in which the roll 12 of foil is received. The housing 14 has no top wall so that upper marginal portions of the front, rear and end walls bound a top opening 32. The housing 14 preferably is constituted of a heavy-duty paper or cardboard material and, in a preferred embodiment of this invention, the housing 14 is a conventional dispenser box which has been modified in the following ways:

Firstly, the conventional hinged top cover has been removed, e.g. by being torn off the housing. Secondly, the box has been turned around so that the wall which carried a serrated cutting blade and which faced forwardly toward a user during use now faces rearwardly away from the user. Put another way, the original front wall has now become the rear wall and, as best shown by arrow 34 in FIG. 3, the roll 12 unwinds counterclockwise rather than clockwise. It is also desirable, although not necessary, to remove the serrated blade from the conventional dispenser box since this blade is no longer needed for any purpose.

The roll 12 is mounted within the interior of the housing 14 between the end walls 24, 26 for turning movement in the direction of the arrow 34 about an axis which extends longitudinally along the housing. The roll 12 includes a tubular core 36, preferably made of a heavy-duty paper or cardboard material, and a coiled, continuous, imperforate supply of a low-shear-resistant, broad, metallic foil 38 is wound about the core. The foil 38 has a free leading end region 40 and a trailing end region 42.

The roll may be supplied in any desired length of foil, and usually is available in commercial quantities of 500 ft., 1000 ft. and more. The width of the foil 38 may come in any desired width, and usually is available in commercial widths of 12", 15", 18" and more. Of course, it will be expressly understood that different lengths and different widths other than those specifically enumerated above are also within the spirit of this invention.

The end regions of the core 36 at opposite axial ends thereof are open, and a pair of stub shafts 44 are freely inserted with a slight clearance into each such open end region. The shafts 44 support the roll 12 for turning movement. Each shaft 44 is held stationary relative to the housing 14 and to the roll 12 by being connected to a rectangular end plate or stationary bearing 46. Each bearing plate 46 rests on the base wall 22 and is juxtaposed with each end wall 24, 26 of the housing.

In use, as explained below, the user grasps the free leading end region 40, preferably with both hands, at the right and left sides of the leading end region 40 of the foil, as best shown in FIG. 2, and pulls a desired length of the foil 38 off the roll to withdraw the desired length of the foil from the housing. During this withdrawal, the roll 12 rotates relative to the stationary stub shafts 44, and the desired length of the foil is payed out. After the first desired length of foil is severed and dispensed, as described below, a second length of foil may be withdrawn in an analogous manner to that described for the first foil length, and this dispensing process continues for successive lengths of foil, each length of foil having a length as desired, depending upon the particular wrapping requirement and being dispensed each in its respective turn.

The cover 16 is mounted over the top opening 32 of the housing, and is snugly fitted over upper marginal portions of the front, rear and end walls thereof. The cover 16 includes a planar top wall 48 located above and lying generally parallel to the base wall 22. A peripheral skirt having a front skirt portion 50, a rear skirt portion 52 and end skirt portions 54, 56 extends generally perpendicularly and downwardly from the top wall 48 and engages exterior surfaces of the upper marginal portions of the front 28, rear 30 and end 24, 26 walls, respectively, of the housing. Once the cover 16 is mounted, the top wall 48 is advantageously elevated a predetermined distance above the top opening 32. Although the cover 16 is shown as being a discrete component of the dispenser, because, in a preferred embodiment, it is desired to mount the cover 16 on existing commercial housings which have been modified as described above, it is also within the spirit of this invention that the cover be integrally and hingedly connected to the housing 14, for example, at the rear wall 30 of the housing, so that the cover 16 can be raised to permit the roll 12 to be received within and loaded into the housing 14 and, thereupon, the cover can be lowered and, in an advantageous construction, locked to the front wall of the housing with a snap-type lock.

The support legs 18 are mounted on the housing 14 for rearwardly tilting the same to a tilted orientation, as shown in FIG. 3, wherein upper marginal portion **28*a* of the front wall 28 is at a higher elevation relative to the support surface 20 than upper marginal portion 30*a* of the rear wall 30. Each support leg has a generally planar end flange 60 which engages a respective end wall of the housing. A front flange 58, a rear flange 59, and a base flange 62 supportably engage the front, rear and base walls of the housing 14, and extend generally perpendicularly and transversely of the end flange 60. The front flange 58, rear flange 59 and base flange 62 support the housing 14 in the tilted orientation of FIG. 3 which is inclined relative to the support surface 20. Each support leg 18 has a foot portion 60*a* extending forwardly of the end flange 60. A pair of front and rear support pads 64, 66 are mounted in recesses provided on the underside of each leg 18. Each pad has a high coefficient of sliding friction, and resists any tendency for the dispenser to be dragged forwardly during withdrawal of the foil. The wide placement between the support pads 64, 66** and the generally pyramidal shape of the dispenser, as well as the very wide base for the dispenser, provide for a very stable dispenser which is resistant to forward tipping over, particularly when the roll is nearly spent and, as a result, the weight of the loaded dispenser is correspondingly low.

A door 68 is pivotably mounted on the top wall 48 of the cover 16 for swinging movement among a plurality of open positions, for example, see FIGS. 4–8, and a closed position, for example, see FIGS. 1–3. The door 68 has a generally planar main door portion 70 which is coplanar with the top wall 48 in the closed position. A plurality of pivot shafts 78 mount the door on the cover at the rear thereof. The door 68 is constantly and affirmatively biased toward the closed position by a biasing means, preferably a set of three torsion coil springs 72, 74, 76, each spring surrounding a respective pivot shaft 78, and having one end bearing against the cover and its other end bearing against a depending lug 79 on the underside of the door portion 70 (see FIG. 5). The springs are operative for pushing the door 68 about the pivot shafts 78 to the closed-door position. The door has a transversely-extending front edge 80 which is located in the closed-door position in close, adjacent, confronting relationship with a transversely-extending edge 82 provided on the top wall 48. The transversely-extending edges 80, 82 bound a slot or top opening 84 (see FIG. 3) which extends transversely of the cover for a distance at least slightly greater than the transverse width of the foil. The slot 84 extends from the interior to the exterior of the dispenser, and enables the foil to extend therethrough.

As best shown in FIG. 5, as it is payed out, the foil 38 is guided from a rear take-off point on the roll 12 along a path under the opened door, then past the front edge of the door, as it is led to the exterior of the dispenser. Initially, the foil is guided over a transversely-extending rotatable idler shaft 86 which is mounted for rotating movement in a pair of journals 88, 90. The journals 88, 90 are stationarily mounted on the cover, and extend outwardly of the end skirt portions 54, 56. The shaft extends transversely across the cover for a distance at least slightly greater than the transverse width of the foil, and preferably is made of metal. During withdrawal of the foil from the dispenser, the foil contacts a then-upper reference surface 92 of the idler shaft 86, and the shaft, at least partially, rotates due to its frictional engagement with, and the withdrawal movement of, the foil. The idler shaft 86 maintains the foil at the same position on the dispenser during discharge no matter how much of the roll has been spent. As more and more foil is removed from the roll 12, the diameter of the coiled foil 38 decreases and, hence, the rear take-off point moves radially inwardly toward the axis of rotation. Despite the changing position of the rear take-off point, the foil must pass over the idler shaft 86 which, because of its fixed location, due to its mounting in the stationary journals 88, 90, ensures that the pre-discharge portion of the foil always will be maintained at the same position.

The foil next is guided during pay-out, as considered in a downstream direction, underneath a generally planar forward projection 94 which is located on, and extends downwardly from, the main door portion 70 slightly behind the front edge 80 of the door. The forward projection 94 extends transversely for a distance at least about slightly greater than the transverse width of the foil, and has a lower drag surface 96 which engages the foil.

The top wall 48 of the cover 16 includes a generally planar bearing wall 98 extending generally perpendicularly downwardly from the top wall. The bearing wall 98 extends transversely for a distance at least slightly greater than the transverse width of the foil, and has a planar, substantially vertical bearing surface 100. In the closed-door position, the bearing wall 98 and the forward projection 94 lie in generally parallel planes, and bound a transversely-extending channel 101 therebetween, which channel opens into the top slot 84. As shown in FIG. 3, the forward projection 94 extends downwardly into the dispenser a predetermined extent sufficient, in the closed-door position, to displace and, at least partially, fold the foil and cause the foil to be routed along a tortuous, serpentine, S-shaped course within the dispenser.

The foil, at the beginning of a pay-out as shown in FIG. 3, is supported at a first location above and on the then upper reference surface 92 of the idler shaft 86, and at a second location on and against the planar, substantially vertical bearing surface 100, and is displaced downwardly by the projection 94 at the drag surface 96 which is located between the first and second aforesaid locations. The foil is initially bent over the idler shaft 86 where it assumes a radius of curvature of one sense which corresponds to the radius of the shaft 86. Since the drag surface 96 of the projection 94 is at a lower elevation than the reference surface 92 in the closed-door position, the projection 94 has displaced the foil and caused the same to be folded and assume a radius of curvature in an opposite sense prior to the foil passing through the channel 101 and through the slot 84 to the exterior of the dispenser, where the leading end region 40, as described in further detail below, thereby stands freely in a generally upright condition and in an unsupported manner, projecting upwardly from the upper edge of the bearing surface 100 against which its lower portion, below said upper edge, leans.

A severing blade assembly 102 is mounted on the top wall 48 at the front of the cover 16. The assembly includes a generally erect, fixed, winged, thin, severing blade 104 having a generally triangular shape. The blade 104 has a central piercing portion 106 located substantially midway between the end walls of the housing, and pointing generally upwardly. The blade 104 also has a pair of wings or tearing portions 108, 110, each tearing portion extending transversely outwardly from the piercing portion 106 toward a respective end wall of the housing. The blade 104 has an upper apex 112, and preferably is tilted forwardly of, and defines a dihedral angle A on the order of 90° relative to, the top wall 48. Advantageously, the angle A ranges from about 80° to about 85° so as to present the apex 112 at an optimum cutting angle relative to the foil for enabling the foil to be cut substantially linearly across its width.

Each tearing portion 108, 110 has a dull, preferably non-serrated, linear, tear edge 114, 116, respectively, each tear edge extending outwardly from the apex 112 in a forward direction outwardly along the top wall, e.g. see FIG. 1, and simultaneously in a downward direction toward the top wall, e.g. see FIG. 3. A pair of L-shaped rear brackets 118, 120 are mounted on the top wall 48 behind the tearing portions 108, 110 to support the blade 104 from the rear, and a prow-shaped front support or ramp 122 is mounted on the top wall in front of the blade 104 to support the same from the front. The blade 104 is clamped securely between the brackets and the ramp, and is thus stationarily mounted on the top wall.

The dispenser operates as follows: Assuming that a fresh roll 12 has already been mounted within the housing 14, that the cover 16 has already been mounted on the top of the housing 14, and that the legs 18 have been mounted at the end regions of the housing 14 for supporting the same with a rearward tilt on the support surface 20, to ready the dispenser for operation a user opens the door 68 and grasps the free leading end region of the foil and pulls the same from the roll. The pulled-out foil is routed over the idler shaft 86 and under the open door. Then the door is permitted to snap shut under the influence of the coil springs 72, 74, 76. Thereupon, the forward projection 94 displaces and, at least partially, dead-folds the foil so that the leading end region 40 leans against the planar, substantially vertical bearing surface 100,causing it to stand up exteriorly of the housing where it extends freely above the top wall 48. As best shown in FIG. 2, the upstanding leading end region 40 thus is readily accessible anywhere along its transverse width. The user advantageously now may initiate a dispensing operation by grasping with both hands the opposite major surfaces of the foil between thumb and forefinger at both the right and left sides of the foil. The user is positioned in front of the dispenser and, as he or she reaches over the severing blade 104 to grasp the foil, it will be noted that there are no sharp teeth anywhere along the forwardly and downwardly sloped tear edges 114, 116 which might otherwise nick and injure the user. The heights of the tear portions at the ends of the cutting blade 104 are at a minimum, so that there is no mechanical interference between the blade and the user's hands. A clear, unobstructed path exists for the user to grasp the foil from the front of the dispenser. The apex 112, which is located at the intersection of the tear edges 114, 116, represents the only peak on the severing blade 104, and the user's hands do not travel over or encounter the apex 112 during use of the dispenser, so that the risk of injury to the user is, for all practical purposes, non-existent.

The next step is for the user to withdraw a desired length of the foil from the roll from underneath the door to an inclined elevated position, as shown in FIGS. 4 and 5, wherein the door 68 is held open by the taut foil 38, and the foil overlies the severing blade 104 and the support, the foil being held at an angle to clear the severing blade while the foil is being payed out.

During this withdrawal, a drag is exerted on the foil to tauten the same. The drag is exerted by several factors. Firstly, the weight of the roll itself and its moment of inertia, i.e. its resistance to being unwound, exerts a drag force on the trailing end region 42 of the foil. Secondly, a certain amount of drag is applied by the various surfaces of the dispenser which engage the foil. These various surfaces include the idler shaft 86 and its bearings, and the drag surface 96. Due to the rolling contact between the foil 38 and the idler shaft 86, the drag surface 96 makes the preponderant contribution to the second drag force. The constant and affirmative urging of the coil springs 72, 74, 76 against the rear trailing end region 42 of the foil positively urges and maintains the drag surface 96 against the foil to keep the foil taut. Thirdly, a certain amount of drag is exerted by the frictional engagement between the stub shafts 44 and the tubular core 36 of the roll 12. If necessary, a frictional drag arrangement of the type described in U.S. Pat. No. 4,610,407 can be employed, the entire contents of said patent application being incorporated by reference herein and made a part of this disclosure.

The next step is to cut the withdrawn taut length of the foil by moving the same from its inclined elevated position clear of the severing blade 104 onto and past the severing blade in a direction generally downwardly toward the planar support surface 20. This downward manual movement usually is performed immediately, and in a smooth, uniform and continuous manner, after the withdrawal movement. During the initial stage of the downward manual movement, the peaked apex 112 of the piercing portion 106 initially pierces a transversely central part of the foil. This situation is shown in FIGS. 6 and 7. Continued downward movement of the foil toward the support surface 20 causes the pierced foil to be severed and torn along the tear edges 114, 116. This constitutes a controlled linear tearing from the central part of the foil outwardly toward the right and left sides of the foil across the entire width of the foil. No uncontrolled rips are started because there are no serrated teeth or sharp edges along the tear edges 114, 116. The rear tilt of the top wall 48, the angle at which the taut foil is presented to the severing blade 104, and the simultaneous forward and downward slope of the tear edges 114, 116 all cooperate so that a substantially linear severance is made across the width of the foil. This is in contrast to certain prior art dispensers wherein the cut-off foil had a chevron-shaped rear trailing edge, which shape wasted foil and was not altogether useful or desirable.

An item 122' to be wrapped, e.g. a sandwich, see FIG.6, is located immediately in front of the dispenser on the support surface. Once a desired length of foil has been fully severed, it is overlaid on the item 122' in the same downward motion used to perform the severing operation. Once the item is overlaid with the foil, the item can be wrapped in a conventional manner. It is thus no longer necessary for the user to perform a separate manual motion as in the prior art, whereby a cut-off length of foil is moved from the side of the dispenser back to the front or laterally before being lowered onto the item.

The dead-folding erecting action performed by the leading edge portion of the foil is interesting to observe. As the foil is severed at its transverse center and then progressively outwardly, but before severance is complete, the foil simply is somewhat bent beneath the drag surface 96 and as it crosses the blade; however, the tip of the leading end region does not erect until the severance is completed at the sides of the foil. At the side edges, the bends of the foil progressively assume the configurations shown in FIG. 8. The progression is: first the full lines, then the dotted lines and, at the last moment, the foil springs into the dot-and-dash line position in which the very leading end portion is erect beyond the dispenser and leans against the bearing surface 100 interiorly of the dispenser.

The dispensing operation is repeated for successive lengths of foil, each length being dispensed in its respective turn.

Turning next to FIG. 11, rather than providing support legs 18, as described and shown in connection with FIGS. 1–10, the housing 14 may be rearwardly tilted using a pair of lifts 130 at the front lower corners of the housing. The lifts are operative for lifting the front lower corners of the housing up above the support surface 20, while advantageously leaving the rear lower corners of the housing on the support surface. Each lift 130 comprises a front clip portion 132 which engages the outer surface of the front wall 28 of the housing, a rear clip portion 134 which resiliently engages an inner surface of the front wall 28, a lift portion 136 which is coplanar with the front clip portion 132, and a base 138 which lies parallel to the support surface 20. A rubber pad 140 of high-friction material is advantageously adhesively secured to the underside of each base 138. The front corners of the housing are provided with a pair of openings 142 at opposite ends of the housing through each of which a respective rear clip portion 134 is inserted.

The aforementioned cover 16 is adapted to snugly fit over and on the upper marginal portions of a housing having a predetermined, size. The cover 16, as well as the legs 18, can be easily removed and mounted on another housing of the same size. Thus, the cover can be reused over and over again as an accessory for modifying the operation of commercially available dispenser boxes,provided they have first been modified as explained above. In the event that a user wishes to mount the cover on a housing of a different size, then the adjustable cover and support leg arrangements of FIGS. 12 and 13 may be used.

As shown in FIG. 12, the rear skirt portion 52 of the cover can be moved relative to the front skirt portion 50. The rear skirt portion 52 has a pair of arms 144, 146 on each of which are outwardly-extending pins 148, 150. A first pair of mounting holes 152, 154 are formed at the rear of the end skirt portions 54, 56, and a second pair of mounting holes 156, 158 are formed at the rear of the end skirt portions 54, 56 forward of and adjacent the first pair. Each such mounting hole is adapted to receive, with a snap-type action, a respective pin 148, 150. By selecting which pair of mounting holes is to receive pins, a user may adjust the cover to the width of the housing. In this way, width adjustments on the order of ½" and more are obtained.

As shown in FIG. 13, each adjustable leg has a bi-partite construction, and includes a support leg 18 substantially as described above, but being modified to have a first pair of mounting holes 166, 168 and a second pair of mounting holes 170, 172. Mounting hole 170 is at a higher elevation than hole 166, and mounting hole 172 is more rearward than mounting hole 168. Each mounting hole is essentially slot-shaped, and holes 166 and 170 are mutually parallel, and holes 168 and 172 are likewise mutually parallel but in a plane which is substantially perpendicular to that of the elongation of holes 166, 170.

The other part of each adjustable leg is a support frame 160 which supportably engages a respective end region of the housing 14. A pair of tongues 162, 164 are respectively mounted on an upright 174 and a rail 176 of each frame 160. The tongues 162, 164 extend along planes which are perpendicular to each other and are adapted to be received with a snap-type action into either the first pair of mounting holes 166, 168, or the second pair of mounting holes 170, 172, as selected by the user. Thus, a user may mount each adjustable leg on housings of different heights and widths.

In accordance with this invention, each free-standing leading end region of the foil ready to be dispensed is positioned away from the severing blade 104 so that the user may gain not only ready access to the upstanding leading end region, but also safe access. The leading end region of the foil is thus prevented from falling back into the dispenser and, of course, the safety hazard no longer exists whereby a user is prone to becoming injured by having to grope around within a dispenser box in the immediate vicinity of sharp teeth on a cutting blade. The time involved in withdrawing desired lengths of foil is greatly reduced because it is no longer necessary for a user to grope around within a dispenser to find and grasp the leading end region of the foil. Aside from the time-saving and safety features of this invention, the health aspects, particularly in food-wrapping operations, are greatly enhanced. The dispenser is not constantly open to dirt, contaminants and vermin, thereby greatly improving the sanitary wrapping environment of food.

The foil dispenser can be used to dispense foils of various thicknesses and, in a preferred embodiment, the thicknesses may vary anywhere from about 0.5 mils to about 5 mils.

The dispenser of this invention can also be used to dispense sheet materials other than metallic foil. For example, waxed paper has sufficient body to freely stand in the closed-door position described above. Other sheet wrapping materials having sufficient body and having similar properties to those of foil and waxed paper could likewise be dispensed in accordance with this invention. Therefore, the phrase "metallic foil" as used throughout the specification and claims hereof is to be understood to be thus broadly interpreted.

Any item may be wrapped with the foil dispensed by this invention. Thus, not only the sandwich 122', but also any food, or non-food, item or container, such as a steam table tray, or, for that matter, any object whatsoever can be so wrapped.

Turning now to FIG. 14, reference numeral 180 identifies another dispenser for dispensing sheet material, especially aluminum foil. The dispenser 180 comprises a support which includes an open-topped housing 182, analogous to housing 14, and having a base wall 184, a front wall 186, a rear wall 188, and end walls 190. The housing walls bound an interior in which a roll 192 of foil is received between the end walls. In contrast to the roll 12, the roll 192 unwinds clockwise in the direction of arrow 194 and, for this purpose, the roll 192 is provided with a tubular core 196 into opposite axial ends of which are freely inserted with a slight clearance respective stub shafts 198. A metallic foil 200, analogous to foil 38, has a free leading end region 202 and a trailing end region 204.

The housing 182 is mounted in a box 206 having a front wall 208, a rear wall 210, a base wall 212, and end walls 214. An inclined support ramp 216 is mounted on the base wall 212 adjacent each end wall 214 of the box 206, and the ramps 216 supportably engage opposite ends of the base wall 184 of the housing 182 to position the housing in a tilted orientation wherein upper marginal portion 186*a* is at a higher elevation relative to a support surface 20 than upper marginal portion 188*a* of the rear wall. A spear-like projection 218 extends upwardly from a central region of base wall 212 and pierces through the base wall 184 of the housing in the lower rear corner region thereof in order to anchor the housing 182 in place within the box 206. Other support surfaces, e.g. 220, 222, are also mounted on the base wall 212 adjacent the front wall 208 of the box 206, and are used to supportably engage the base walls of housings which are larger in size than the housing 182 and which are used to house rolls of larger size.

Support legs 224, 226 are integral with the box 206 and support the same on the support surface 20. The aforementioned discrete support legs 18, which were mounted at opposite end regions of the housing 14, were subject to being misplaced, and this aspect is obviated by the one-piece construction of the legs 224, 226 with the box 206.

A cover 228 is snugly mounted over the open top of the box 206. The cover 228 has a top wall 230 above the open top of the box 206, a front skirt portion 232 which engages the front wall 208, a rear skirt portion 234 which engages the rear wall 210, and a pair of end skirt portions 236 which engage the end walls 214.

A door 238 is pivotably mounted on the top wall 230 of the cover 228 for swinging movement between a closed and an open position, respectively, shown in solid and phantom lines in FIG. 15. Tubular hinges having pivot shafts 240 mount the door 238 for such movement at the rear of the top wall 230. The door 238 is constantly and affirmatively biased by a biasing means, preferably torsion coil springs 242, at each hinge, toward the closed position which is determined by abutment of the door 238 with a pair of stops 244 provided at the underside of the top wall 230 at opposite ends of the door 238. In contrast to the previously described door 68 which was movable among a plurality of positions during the withdrawal and severing of successive foil lengths, the door 238 remains in the closed position during such foil withdrawal and foil severing. The door 238 is only opened to the open position after the housing 182 is placed within the box 206 so that one can gain ready access to the initial leading end region of the foil and pull such initial foil end region through the wide opening formed by the open door 238. The door 238 is thereupon closed and remains closed throughout the dispensing operation.

It will be noted that the door 238 has a projection 246 which, in the closed position of the door, is spaced from a U-shaped bearing portion 248 of a movable locking member 250 which has a pair of transversely spaced-apart outer locking legs 250' and a central locking leg 250" (see FIG. 16). The curved bearing portion 248 and the projection 246 extend transversely for a distance at least slightly greater than the transverse width of the foil and bound a transversely-extending channel or top opening 252 through which the foil passes during foil withdrawal. The locking member 250 is located underneath the top wall 230 and is movable, by the foil 200 itself during forward withdrawal thereof by the user; from a latched position shown in FIG. 15 wherein the bearing portion 248 urges the foil toward the projection 246 so as to form a fold in the foil and cause the free leading end region 202 to stand freely in a generally upright condition and in an unsupported manner as depicted in FIG. 14, to an unlatched position shown in FIG. 18 wherein the foil 200 has pushed the locking member generally forwardly in the direction of arrow 254. After the withdrawn foil has been severed, as described below, the locking member 250 automatically returns from the unlatched to the latched position by the restoring action exerted by a pair of coil springs 256 located underneath the outer locking legs 250' of the locking member 250.

As shown in FIGS. 16 and 17, each spring 256 has one end 258 in engagement with the front side of stationary wall 260 depending from the top wall 230, and an opposite end 262 fitted snugly within a cup 264 which, in turn, is fitted snugly in the bend of the U-shaped bearing portion 248. Each opening 256 is operative to constantly and affirmatively return the locking member 250 back to the latched position which is determined by abutment of a pair of stops 266 provided on the underside of each outer locking leg 250' with the rear side of the stationary wall 260. It is not necessary that the bearing portion 248 during its return movement urge the foil against the projection 246 and, in fact, it is preferable if the foil is not pinched between the bearing portion 248 and the projection 246, because a pinching action, particularly a vigorous one, tends to mar or unduly crease the foil. It is merely sufficient for the returning bearing portion 248 to form a dead-fold in the foil, and the inherent body or stiffness characteristic of the foil will enable the free end region 202 to stand upright.

A severing blade assembly 270, analogous to blade assembly 102, is mounted on the top wall 230 at the front of the cover 228. The assembly includes a fixed blade 272 having a central upwardly-pointing piercing portion 274 midway between the end walls of the cover 228, and a pair of tearing portions 276, 278 each extending transversely outwardly from the piercing portion toward a respective end skirt portion 236 of the cover. Each tearing portion has a dull, linear tear edge 280, 282, respectively, extending not only outwardly from the piercing portion, but also downwardly and forwardly toward the top wall 230. A pair of L-shaped rear brackets 284 are mounted on the top wall 230 behind the tearing portions 276, 278 to support the fixed blade 272 from the rear, and a prow-shaped front support or ramp 280 is mounted on the top wall 230 in front of the blade 272 to support the same from the front.

A displaceable safety means or guard 286 is mounted on the top wall 230 for displacement relative to the fixed blade 272 between a raised guarded position (FIG. 17) in which the guard extends above the tearing portions 276, 278 of the blade 272 and renders the same inoperative for severing, and a lowered cutting position (FIG. 18) in which the guard lies below the tearing portions 276, 278 and enables severing to be performed. The displacement is in the up-and-down direction denoted by double-headed arrow 288 in FIG. 17, and extends generally normal to the plane of the top wall 230, as well as generally normal to the plane of the taut withdrawn sheet material during severing. The guard is located between the front support 280 and the fixed blade 272.

As best shown in FIG. 16, the guard 286 is preferably constituted of right and left guard sections 286', 286" at opposite lateral sides of the piercing portion 274 of the blade 272. As best shown in FIG. 19, each guard section has a pair of spaced-apart fingers 288, 290 around each of which is located a coil spring 292. Each coil spring is supported by a fingerlike support 294 formed in a depending flange 296 of the top wall 230. Each support 294 is juxtaposed with a respective finger. The springs yield to permit downward displacement of the guard sections, but constantly exert upward force to displace the guard sections upwardly to the raised position.

The guard 286 is normally locked in the raised position. For this purpose, each outer leg 250' has a blocking position 300 which is received in slots 302, 304 formed in guard 286 and flange 296, respectively. The central leg 250" also has a pair of blocking portions 306, 308 which are received in corresponding slots formed in guard 286 and flange 296. The receipt of the blocking portions in the slots acts as a barrier and prevents downward displacement of the guard.

It will also be noted that each leg of the locking member 250 has cutouts adjacent each blocking portion. Thus, each outer leg 250' has a cutout 310, and the central leg 250" has a pair of cutouts 312 at either side thereof. The receipt of each cutout in a respective one of the aforementioned slots acts as a release for releasing the locking member and permitting downward displacement of the guard. The movement of the legs of the locking member 250 between the solid and dashed lines of FIG. 16 so that the blocking portions are initially moved out of the slots, and then the cutouts are moved into the slots, is accomplished, as described previously, by the force exerted by the taut sheet material itself on the locking member during each withdrawal of the sheet material.

In operation, one grasps the leading end region 202 of the sheet material anywhere along its width, the sheet material being upstanding due to the material characteristics of the material itself, as well as due to the deadfolding of the material caused by the rearward movement of the locking member 250 toward the flange 246 of the closed door 238. The sheet material is pulled upwardly and forwardly until the desired length has been withdrawn. Then., in a single, uniform motion, the withdrawn material is pulled down. During all this time, the piercing and tearing portions of the blade are located below the guard. Hence, even if one should pass his hand over this region, there is no chance that injury could occur, because the person's hand would first strike the safety guard. The guard is locked in the raised position because the blocking portions obstruct downward movement of the guard.

During withdrawal of the material, eventually the point is reached where the blocking portions no longer obstruct downward movement of the guard. When the material is pulled down, the material first engages the guard, pushes the guard down until the material engages the piercing portion (see FIG. 18), and then engages the tearing portions to complete the severing action. Once the material has been completely severed, the coil springs 292 return the guard to the raised position. The springs 256 return the locking member to its original position. The leading end region of the material is positioned to be safely and readily accessible.

In the embodiment of FIGS. 16–19, the upper tearing portions are shown to be non-serrated, as described previously in the earlier embodiments. However, the provision of the safety guard allows the upper tearing portions of the blade to be sharp and serrated, all without increasing the safety risk. This is shown in the blade modification of FIG. 20, where teeth 320 are illustrated. Such a serrated blade is of particular advantage when the sheet material is plastic film.

It will be understood that each of the elements described above, or two or more together, also may find a useful application in other types of constructions differing from the types described above.

While the invention has been illustrated and described as embodied in a sheet material dispenser for and methods of dispensing sheet material and of wrapping items therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A dispenser, comprising:

(a) a support having a base and a top above the base, said top having a generally planar top wall having transverse edges bounding an opening extending through the planar top wall;

(b) a roll mounted on the support for turning movement about an axis, said roll having a coiled, continuous, imperforate supply of a broad, sheet material web wound about the axis, and unwindable during use for successively paying out a desired length of the web when successive leading end regions of the web are respectively manually grasped by a user in a ready-to-use position and the desired length of the web is withdrawn from the roll along a path through the opening to a position spaced from and at least partially overlying the support, said transverse edges of the top wall generally being in an adjacent confronting relationship in the plane of the top wall in the ready-to-use position;

(c) means for exerting a drag on each successively withdrawn length of the web to tauten the same during withdrawal;

(d) means on the support for severing each successively withdrawn, taut length of the web when the same is moved from the aforesaid spaced position onto the severing means in a direction generally toward the base; and (e) bearing means on the support for positioning each successive leading end region of the web in the ready-to use position to extend in an unsupported manner from the adjacent confronting transverse edges of the top wall in a generally normal direction relative to the top wall and to stand freely in a generally erect condition spaced from the severing means, thereby enabling the user to gain ready and safe access to each upstanding leading end region of the web along the transverse width thereof for paying out a fresh length of web.

2. The dispenser as recited in claim 1, wherein the support includes an elongated housing having a base wall, a pair of end walls, a front wall, and a rear wall, all of the walls of the housing bounding an interior in which the roll is received; and wherein the top of the support includes a discrete cover having said top wall, said discrete cover being mounted on the housing so that the top wall overlies the base wall of the housing.

3. The dispenser as recited in claim 2, wherein the front, rear and end walls of the housing have upper marginal portions, and wherein the top wall is generally planar; and wherein the cover has a peripheral skirt extending generally perpendicularly and downwardly from the top wall and fitted snugly over the upper marginal portions of the front, rear and end walls of the housing.

4. The dispenser as recited in claim 3, wherein the base is adapted to be mounted on a generally planar support surface, and includes means for rearwardly tilting the housing so that the upper marginal portion of the front wall is at a higher elevation relative to the support surface than the upper marginal portion of the rear wall.

5. The dispenser as recited in claim 4, wherein the tilting means includes a pair of end supports having flanges for supportably engaging the walls of the housing and positioning the same in a tilted orientation.

6. The dispenser as recited in claim 5, wherein each end support has a leg mounted on the support surface, and a retainer for holding the housing; and further comprising means of adjustably mounting the retainer and the housing held thereon on each leg.

7. The dispenser as recited in claim 3, wherein the peripheral skirt includes front, rear and end sheet portions respectively engaging the upper marginal portions of the front, rear and end walls of the housing; and further comprising means for adjustably mounting the front and rear sheet portions for movement toward and away from each other.

8. The dispenser as recited in claim 1, wherein the roll includes a tubular core about which the web is wound, said core having opposite open axial end regions; and wherein the support includes means for bearing the roll for said turning movement, said bearing means including means freely insertable into each open end region of the core for supporting the roll for said turning movement during successive withdrawals of the web.

9. The dispenser as recited in claim 1, wherein each successively withdrawn length of the web at least partially overlies the top wall in the spaced position.

10. The dispenser as recited in claim 9, wherein the top wall includes a door mounted on the top wall for movement among a plurality of open positions in each of which the successively withdrawn web lengths are at least partially juxtaposed with the top wall, and a closed position in which each successive leading end region is in the generally erect, upstanding condition relative to the top wall.

11. The dispenser as recited in claim 10, wherein the door and the top wall have said transverse edges bounding the opening through which the web is withdrawn, said transverse edges being in said adjacent, confronting relationship with each other in the closed position of the door.

12. The dispenser as recited in claim 10, wherein the door has a generally planar door portion which is coplanar with the top wall in the closed position of the door.

13. The dispenser as recited in claim 10, wherein the drag exerting means includes a transversely-extending, web-engaging drag surface on the door, and biasing means for affirmatively urging the door toward the closed position and the drag surface into affirmative engagement with the web.

14. The dispenser as recited in claim 10, wherein the bearing means includes a transverse projection on and extending downwardly from the door, and wherein the top wall includes a transverse bearing surface adjacent the projection in the closed position of the door, and wherein the projection engages one side of the web and positions the opposite side of the web against the bearing surface to at least partially fold the web and cause each upstanding leading end region to stand substantially erect exteriorly of the dispenser when the door is in the closed position.

15. The dispenser as recited in claim 14, wherein the bearing surface extends downwardly of the top wall and lies generally parallel to the projection in the closed position of the door.

16. The dispenser as recited in claim 9, wherein the severing means is mounted on and extends upwardly from the top wall, said severing means including a piercing portion operative for piercing the web moved downwardly thereon, and a pair of tearing portions operating for tearing the web moved downwardly thereon.

17. The dispenser as recited in claim 16, wherein the piercing portion is centrally located on the top wall, and each tearing portion extends transversely outwardly from the piercing portion.

18. The dispenser as recited in claim 17, wherein the tearing portions include dull, non-serrated tear edges along which the web is torn.

19. The dispenser as recited in claim 18, wherein the tear edges linearly extend from the piercing portion both forwardly and downwardly of the top wall, for tearing each successive trailing end region of the web in a line across the entire width of the web.

20. The dispenser as recited in claim 19, wherein the top wall is substantially planar, and wherein the piercing portion is tilted forwardly of, and defines a dihedral angle slightly less than 90° relative to, the top wall.

21. The dispenser as recited in claim 9, wherein the top wall includes a door mounted on the top wall for movement between open and closed positions in which access is permitted and denied respectively to the roll, one of said transverse edges being on the door; and wherein the bearing means includes a movable member mounted on the top wall for movement relative thereto by the web during said withdrawal, said movable member having the other transverse surface and being constantly urged toward said one transverse surface to at least partially fold and maintain the web in said generally erect condition in the ready-to-use position.

22. The dispenser as recited in claim 21, wherein said door is maintained in the closed position during said withdrawal of the web and has a depending projection, and wherein said movable member has a bearing portion facing said projection.

23. The dispenser as recited in claim 1; and wherein the support includes a reference surface which engages and positions the web at the same reference position for all withdrawals of the web including when the roll is almost completely spent.

24. The dispenser as recited in claim 1 wherein the web is a low-shear-resistant, metallic foil.

25. A dispenser, comprising:

(a) a support having a base and a top above the base, said support bounding an opening;

(b) a roll mounted on the support for turning movement about an axis, said roll having a coiled, continuous, imperforate supply of a low-shear-resistant, broad, metallic foil wound about the axis, and unwindable during use for successively paying out a desired length of the foil when successive leading end regions of the foil are respectively manually grasped by a user and the desired length of the foil is withdrawn from the roll along a path through the opening to a position spaced from and at least partially overlying the support;

(c) means for exerting a drag on each successively withdrawn length of the foil to tauten the same during withdrawal;

(d) means on the support for severing each successively withdrawn, taut length of the foil when the same is moved from the aforesaid spaced position onto the severing means in a direction generally downwardly toward the base, said severing means including a piercing portion operative for piercing the foil moved downwardly thereon, and a pair of tearing portions each having dull, non-serrated tear edges extending downwardly and forwardly away from the piercing portion and operative for tearing the foil moved downwardly thereon across the entire width of the foil; and (e) means on the support for positioning each successive leading end region of the foil, after the preceding length of the foil has been cut, away from the severing means and readily and safely accessible to the user.

26. An arrangement for modifying the operation of an upwardly-open dispenser box in which is mounted for turning movement a roll of a coiled, continuous, imperforate supply of a low-shear-resistant, broad, metallic foil of the type which unwinds during use when a user manually grasps a leading end region of the foil in a ready-to-use position and withdraws a desired length of the foil from the roll to an elevated position relative to a generally planar support surface on which the box rests, said arrangement comprising:

(a) a cover mounted over and on the upwardly-open dispenser box, said cover having a generally planar top wall having transverse edges bounding an opening extending through the top wall, said transverse edges generally being in an adjacent confronting relationship in the plane of the top wall in the ready-to-use position;

(b) means on the cover for exerting a drag on each successively withdrawn length of the foil to tauten the same during withdrawal;

(c) means on the cover for severing each successively withdrawn, taut length of the foil when the same is moved from the elevated position onto the severing means in a direction generally downwardly toward the support surface; and (d) means on the cover for positioning each successive leading end region of the foil, after the preceding length of the foil has been severed, in the ready-to-use position to extend in a unsupported manner from the adjacent confronting transverse edges of the top wall in a generally normal direction relative to the top wall and to stand freely in a generally upright condition away from the severing means, thereby enabling the user to gain ready and safe access to each upstanding leading end region of the foil along the transverse width thereof.

27. The arrangement as recited in claim 26, wherein the severing means is mounted on and extends upwardly from the cover, said severing means including a piercing portion operative for piercing the foil moved downwardly thereon, and a pair of tearing portions operative for tearing the foil moved downwardly thereon.

28. A method of dispensing a coiled, continuous, imperforate supply of a low-shear-resistant, broad, metallic foil wound on a roll mounted for turning movement on a support having a generally planar top wall with transverse edges bounding an opening which extends through the top wall, comprising the steps of:

(a) unwinding the foil by manually grasping successive leading end regions of the foil in a ready-to-use position and withdrawing desired lengths of the foil from the roll to elevated positions at least partially overlying the support;

(b) exerting a drag on each successively withdrawn length of the foil to tauten the same during withdrawal;

(c) severing each successively withdrawn, taut length of the foil by manually moving the same in a single downward motion from a respective elevated position in a generally downward direction onto a severing element mounted on the support; and (d) positioning each successive leading end region of the foil, after the preceding length of the foil has been severed, away from the severing element in the ready-to-use position, said positioning step including positioning the transverse edges generally in an adjacent confronting relationship in the plane of the top wall in the ready-to-use position, and at least partially folding each successive leading end region of the foil to extend in an unsupported manner from the adjacent confronting transverse edges of the top wall in a generally normal direction relative to the top wall and to stand freely in a generally erect condition.

29. A method of modifying the operation of a dispenser box of the type including a hinged top wall, a serrated cutting blade, and a coiled, continuous, imperforate supply of a low-shear-resistant, broad, metallic foil wound on a roll mounted for turning movement within the box, said method comprising the steps of:

(a) removing the hinged top wall;

(b) turning the box around so that the front of the box faces the rear;

(c) mounting a cover support on the top of the box;

(d) unwinding the foil by manually grasping successive leading end regions of the foil and withdrawing desired lengths of the foil from the roll to elevated positions at least partially overlying the support;

(e) exerting a drag on each successively withdrawn length of the foil to tauten the same during withdrawal;

(f) severing each successively withdrawn, taut length of the foil by manually moving the same in a single downward motion from a respective elevated position in a generally downward direction onto a severing element mounted on the support; and (g) positioning each successive leading end region of the foil, after the preceding length of the foil has been severed, away from the severing element.

30. The method as recited in claim 29, wherein the positioning step includes causing each successive leading end region of the foil to stand freely in a generally erect condition and in an unsupported manner.

* * * * *